US010690329B2

(12) United States Patent
Terumichi

(10) Patent No.: US 10,690,329 B2
(45) Date of Patent: Jun. 23, 2020

(54) POWER SUPPLY BOX DEVICE

(71) Applicant: MODULEX INC., Tokyo (JP)

(72) Inventor: Goro Terumichi, Tokyo (JP)

(73) Assignee: MODULEX INC., Tokyo (JP)

( * ) Notice: Subject to any disclaimer, the term of this patent is extended or adjusted under 35 U.S.C. 154(b) by 0 days.

(21) Appl. No.: 16/475,850

(22) PCT Filed: Dec. 28, 2017

(86) PCT No.: PCT/JP2017/047313
§ 371 (c)(1),
(2) Date: Jul. 3, 2019

(87) PCT Pub. No.: WO2018/128170
PCT Pub. Date: Jul. 12, 2018

(65) Prior Publication Data

US 2019/0353335 A1 Nov. 21, 2019

(30) Foreign Application Priority Data

Jan. 5, 2017 (JP) ..... 2017-000713

(51) Int. Cl.
*F21V 21/34* (2006.01)
*F21V 23/00* (2015.01)
(Continued)

(52) U.S. Cl.
CPC ..... *F21V 21/34* (2013.01); *F21V 23/001* (2013.01); *F21V 23/007* (2013.01); *H01R 25/14* (2013.01); *H01R 41/00* (2013.01)

(58) Field of Classification Search
CPC ..... F21V 21/34; F21Y 101/00; A47H 1/10
See application file for complete search history.

(56) References Cited

U.S. PATENT DOCUMENTS 5,553,373 A * 9/1996 Sprayberry ..... F21V 19/04 29/278
6,464,190 B1 * 10/2002 Aramaki ..... F21V 21/38 248/327

(Continued)

FOREIGN PATENT DOCUMENTS

JP 2013-077478 A 4/2013
JP 2013077478 A * 4/2013

(Continued)

*Primary Examiner* — Abdullah A Riyami
*Assistant Examiner* — Nader J Alhawamdeh
(74) *Attorney, Agent, or Firm* — Metrolex IP Law Group, PLLC

(57) ABSTRACT

Provided is a power supply box device that improves design properties by keeping an operation lever from being visible from outside and that prevents misoperations caused by the operation lever being touched by mistake. A power supply box device 1 that comprises a plug 30: that has an operation lever 31*m* that protrudes in a radiation direction from a plug main body and extends downward; and that is supported by a lid member so as to be capable of forward and reverse rotation. A box main body has: a housing 12 that houses a power supply; and a lever cover 13 that is supported by the housing 12 so as to be capable of ascending/descending between a lock position that is on an upper side and a lock release position P2 that is on a lower side. The lever cover 13 is arranged in the lock release position P2 to allow the operation lever 31 m to rotate and covers the operation lever 31*m* by ascending, relative to the operation lever as arranged in a prescribed position, from the lock release position to the lock position.

3 Claims, 18 Drawing Sheets

(51) Int. Cl.
*H01R 25/14* (2006.01)
*H01R 41/00* (2006.01)

(56) References Cited

U.S. PATENT DOCUMENTS

2018/0003369 A1* 1/2018 Fujisawa ..... H01R 25/142
2019/0353335 A1* 11/2019 Terumichi ..... F21V 21/34

FOREIGN PATENT DOCUMENTS

JP 2015-088428 A 5/2015
JP 2016-039093 A 3/2016

* cited by examiner

POWER SUPPLY BOX DEVICE

TECHNICAL FIELD

This relates to a power supply box device to be mounted to and removed from a wiring duct from below.

BACKGROUND

Patent Document 1 discloses a power supply box device to be mounted to and removed from (attached to and detached from) a wiring duct from below.

Attachment and detachment of a power supply box device of this type is generally performed by rotating forward or backward an operation lever that protrudes in a radial direction from a plug body.

For example, when the power supply box is to be mounted, an operator holds the power supply box device with one hand, and inserts a plug electrode or a fixing member into a duct groove of a wiring duct, and rotates the operation lever forward with the other hand. By this operation, the power supply box is electrically connected and secured to the wiring duct. On the other hand, when the power supply box is to be removed, the operator holds the power supply box device with one hand, and rotates the operation lever backward with the other hand. By this operation, the electrical connection and the securing to the duct is released and then the power supply box device is removed from the wiring duct.

The attachment and detachment of the power supply box device described above is performed to the ceiling, and thus the operator needs to handle the operation lever in an unnatural posture, for example, standing on a stepladder with operator's hands raised upward.

For this reason, the operation lever has a size easy to handle and is disposed in a position easy to operate, for example, in a position protruding in a radial direction from the plug body.

PRIOR ART

Patent Document 1: JP 2013-77478A

SUMMARY OF THE INVENTION

Problems to be Solved by the Invention

However, since the operation lever has a size easy to handle and is disposed in a position easy to operate, there have been issues, such as the operation lever is visible from outside and thus the design of the device is degraded, and an erroneous operation is caused by a user inadvertently touching the operation lever.

The present invention is made in view of the issues described above, and aims to provide a power supply box device, in which design is improved by preventing the operation lever from being visible from outside, and an erroneous operation that would be otherwise caused by a user inadvertently touching the operation lever is prevented.

Means for Solving the Problems

To achieve the aim described above, the present invention is characterized in that a power supply box device to be mounted to a wiring duct from below comprises: a power supply box including a box body having an opening that opens upward, and a lid member for closing the opening; and a plug having an operation lever protruding in a radial direction from a plug body and extending downward, and is supported by the lid member so as to be capable of being rotated forward and backward. The box body includes: a housing for housing a power supply; and a lever cover supported by the housing so as to be capable of ascending and descending between an upper locked position and a lower unlocked position. The lever cover is configured to allow the rotation of the operation lever when disposed in the unlocked position, and, for the operation lever disposed in a predefined position, to cover the operation lever by ascending from the unlocked position to the locked position.

Effect of the Invention

According to the present invention, when the lever cover is disposed at the locked position, the lever cover covers the operation lever being located at the predefined position, and thus the operation lever is not visible from outside and design can be improved, and an erroneous operation of the operation lever can also be prevented.

BRIEF DESCRIPTION OF THE DRAWINGS

FIG. 1 is an oblique view of the power supply box device 1.

FIG. 2 is an oblique view of the power supply box device 1, with a lever cover 13 being disposed at an unlocked position P2.

FIG. 3 is an exploded oblique view of the power supply box device 1.

FIG. 4 is an oblique view of the power supply box device 1, which is mounted to a wiring duct 5, and to which a lighting fixture 6 is mounted.

FIG. 5 is a rear view of the power supply box device 1 mounted to the wiring duct 5.

FIG. 6 is an exploded oblique view of a plug 30.

FIG. 7 is a plan view of the plug 30, a slide member 23, a lug member 24, a guide member 25, and an electrode 12*d* of a box body 11, when an operation lever 31*m* is disposed at a first position R1.

FIG. 8 is a front view thereof.

FIG. 9 is a plan view of the plug 30, the slide member 23, the lug member 24, the guide member 25, and the electrode) 2*d* of the box body 11, when the operation lever 31*m* is disposed at a second position R2.

FIG. 10 is a front view thereof.

FIG. 11 is a plan view of the plug 30, the slide member 23, the lug member 24, the guide member 25, and the electrode 12*d* of the box body 11, when the operation lever 31*m* is disposed at a third position R3.

FIG. 12 is a front view thereof.

FIG. 13 is a plan view of the plug 30, the slide member 23, the lug member 24, the guide member 25, and the electrode 12*d* of the box body 11, when the operation lever 31*m* is disposed at the second position R2 and the lug member 24 is disposed at a retracting position T2.

FIG. 14 is a front view thereof.

FIG. 15 is an exploded oblique view of the power supply box device 2.

FIG. 16 is an exploded oblique view of a portion of the power supply box device 2.

FIG. 17 is a left side view of a plug 80 of the power supply box device 3.

FIG. 18 is a front view of a wiring duct 7, with which or from which the plug 80 is engaged or disengaged.

EMBODIMENTS FOR IMPLEMENTING THE INVENTION

Figure 1:
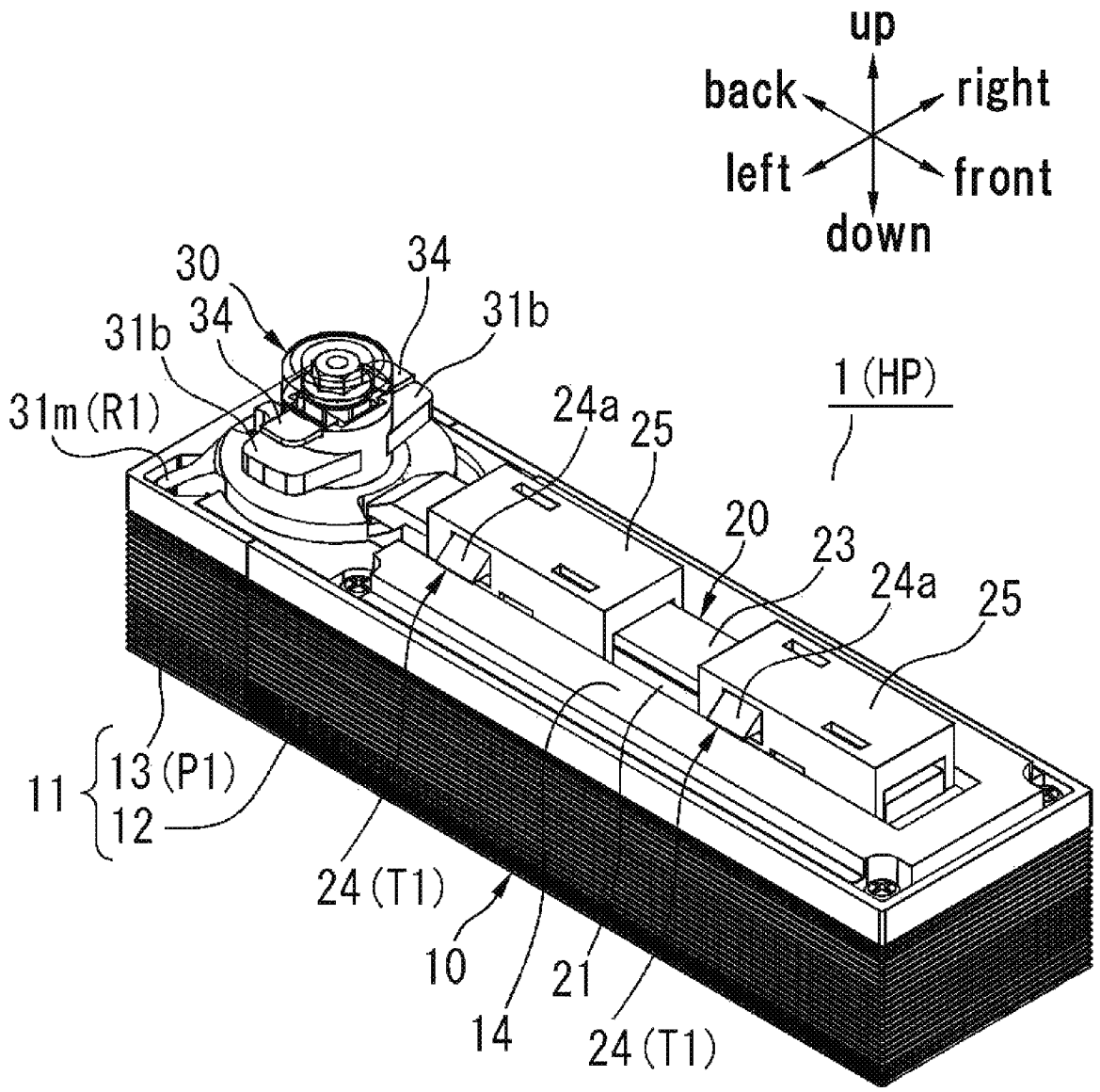
FIGS. 1 to 14 are diagrams illustrating a power supply box device 1 of Embodiment 1.

Embodiments to which the present invention is applied are described hereinafter in detail, based on drawings. In drawings, components designated by the same reference numeral have the same or a similar configuration, and duplicate explanation thereof is omitted as appropriate. In addition, in each of the drawings, components or the like that are not necessary for explanation are omitted as appropriate.

Embodiment 1

The power supply box device 1 according to Embodiment 1 to which the present invention is applied is described below, with reference to FIGS. 1 to 14.

Among them, FIG. 1 is an oblique view of the power supply box device 1.

Figure 2:
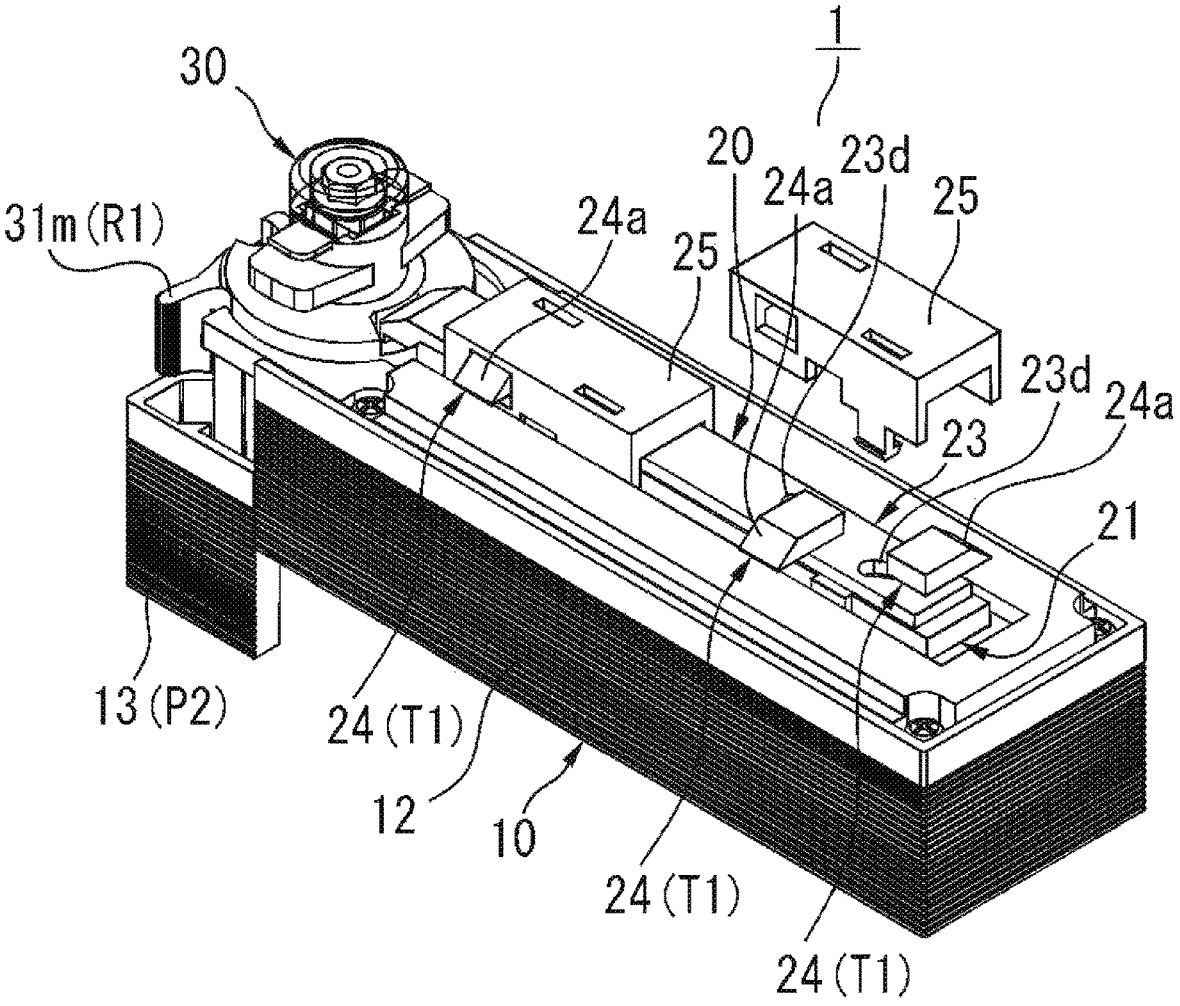

FIG. 2 is an oblique view of the power supply box device 1 when the lever cover 13 is disposed at the unlocked position P2. However, please note that the guide member 25 on the front side is illustrated in FIG. 2 as being removed.

Figure 3:
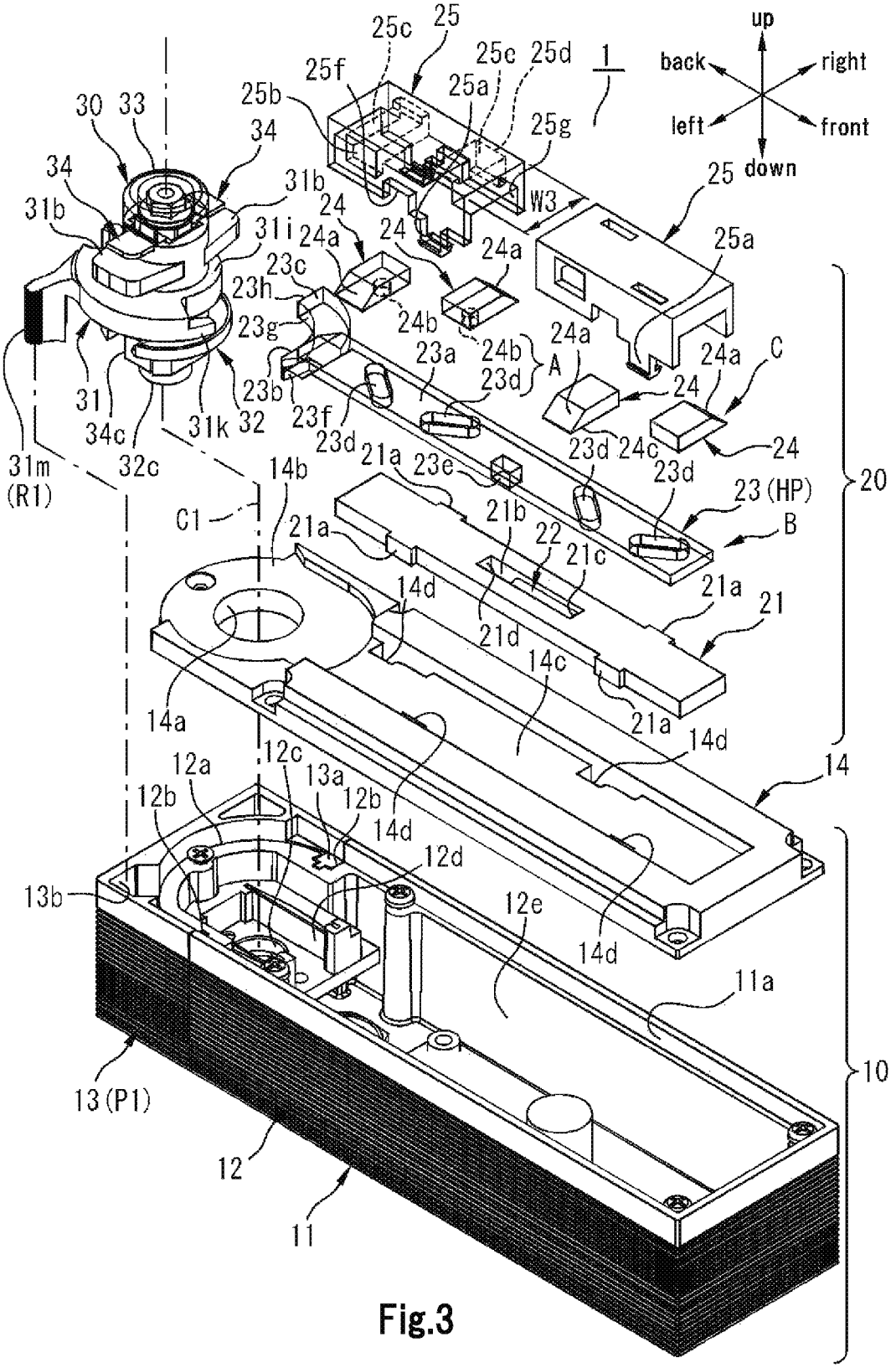

FIG. 3 is an exploded oblique view of the power supply box device 1. However, please note that the slide member 23, two rear lug members 24 among four lug members 24, and one of two guide members 25 are shown in a perspective view.

Figure 4:
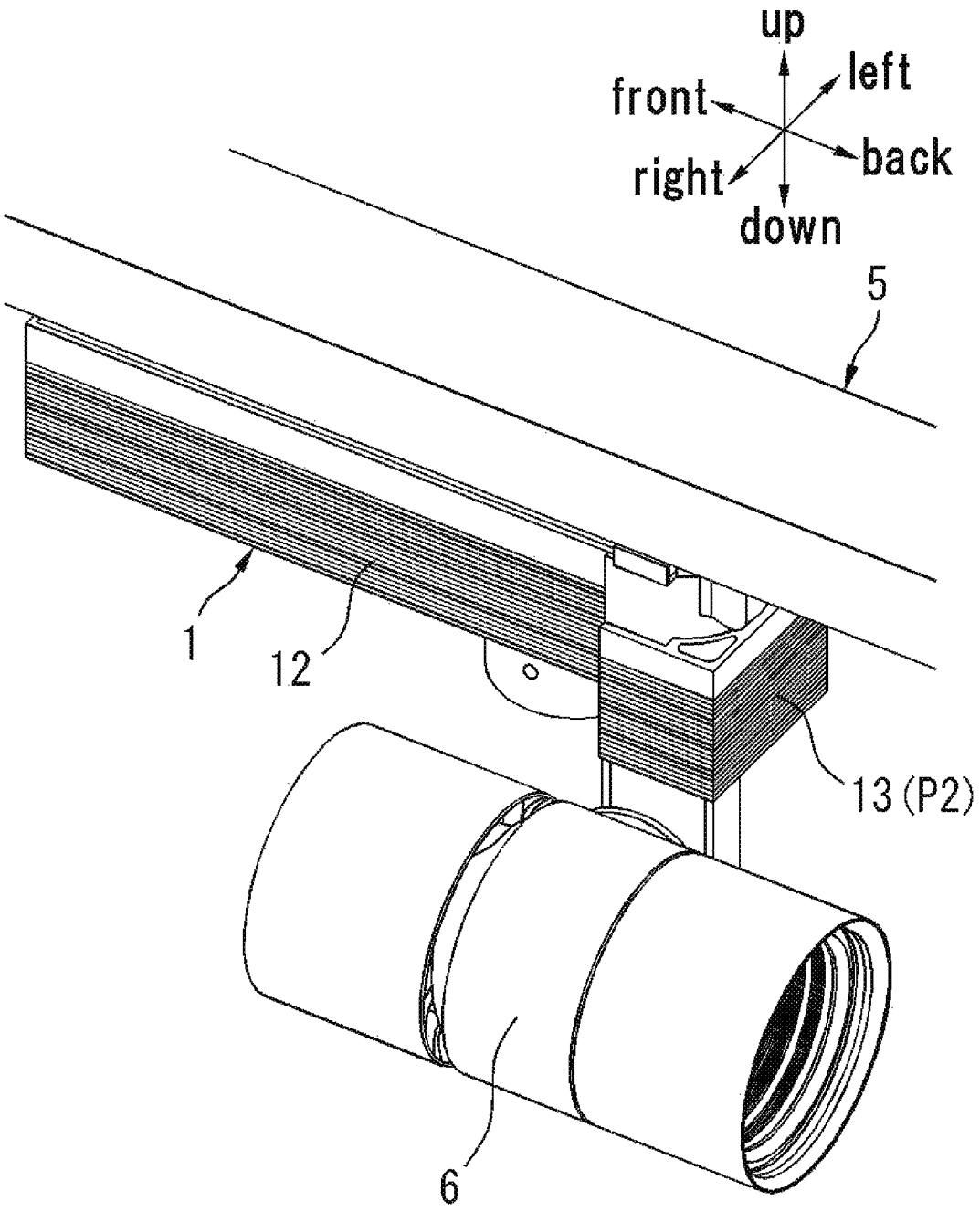

FIG. 4 is an oblique view of the power supply box device 1, which is mounted to the wiring duct 5, and to which the lighting fixture 6 is mounted.

Figure 5:
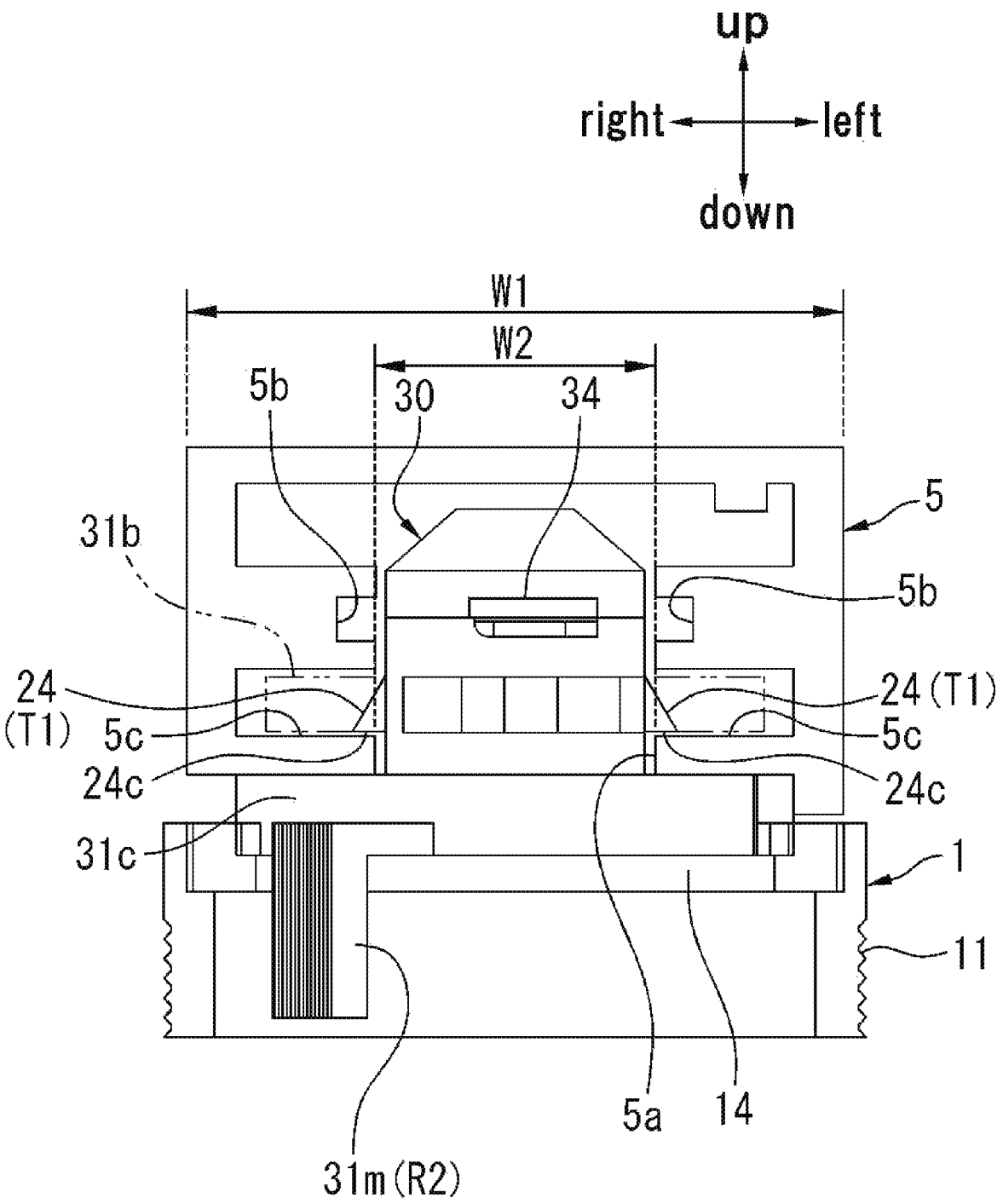

FIG. 5 is a rear view of the power supply box device 1 mounted to the wiring duct 5.

In the description below, "front, back, left, right, up, down" indicated by arrows in FIG. 1, and FIGS. 3 to 8 are considered to correspond to the "front, back, left, right, up, down" of the power supply box device 1 or the wiring duct 5. In addition, components described hereinafter that configure the power supply box device 1 are considered to be disposed in respective home positions HP when the power supply box device 1 and its components are in a state as illustrated in FIG. 1, FIG. 3, or FIGS. 6 to 8. In addition, in the description, the position of the plug 30 is considered to be the position of the operation lever 31*m* described below.

The wiring duct 5, to which or from which the power supply box device 1 is to be mounted or removed, is an elongated member extending in one direction as illustrated in FIG. 4 and FIG. 5, and is provided in a ceiling surface (not shown), for example. As illustrated in FIG. 5, when the width of the wiring duct 5 (dimension in a left-right direction) is defined as W1, a duct groove 5*a* having a width W2 that is smaller than the width W1 opens downward at the center in a left-right direction of the wiring duct 5. A wiring groove 5*b* opening inward is provided in an upper portion of the duct groove 5*a*, respectively both on the left and right sides. A conductive plate (not shown) is provided in these wiring grooves 5*b*, in a front-back direction. Note that an electrode 34 of the plug 30 described below is connected to and disconnected from these conductive plates. In addition, a pair of rail portions 5*c* are formed in a lower portion of the duct groove 5*a*, on the left and right sides. A planar sliding surface 24*c* of a lug member 24 disposed in a protruding position T1 described hereinafter is mounted on and engaged with the rail portion 5*c* from above.

Next, the power supply box device 1 is described below.

The power supply box device 1 comprises a power supply box 10, a temporary jointing mechanism 20, and a plug 30, as illustrated in FIGS. 1 to 3.

Among them, the power supply box 10 is configured by closing an opening 11*a* of a box body 11 by a lid member 14.

The box body 11 is formed in a rectangular cuboid shape being longitudinal in the front-back direction, and has the opening 11*a* that opens upward. The box body 11 comprises: a housing 12 provided on the front side and occupying most of the box body 11; and a lever cover 13 supported at the back of the housing 12 so as to be capable of ascending and descending.

As illustrated in FIG. 3, the housing 12 has a wall surface 12*a* on the back end, and the wall surface 12*a* is semicircular in a plan view (the shape viewed from above). Guide grooves 12*b* respectively extending in an up-down direction are formed near the front end of the wall surface 12*a* on the right and left sides. A through hole 12*c* centering on the shaft center C1 in the up-down direction is formed between these two guide grooves 12*b*. The shaft center C1 is a rotation center of the plug 30 described below. A pair of electrodes 12*d* opposing each other are disposed on the left and right sides of the through hole 12*c*. There is a storage space 12*e* in the housing 12, in which a power supply (not shown) of the lighting fixture 6 is to be stored.

On the other hand, the lever cover 13 has an engagement convex portion 13*a* for engaging with the guide groove 12*b* of the housing 12, and is capable of ascending and descending between a locked position P1 illustrated in FIGS. 1 and 3, and an unlocked position P2 illustrated in FIG. 2. A lever storage portion 13*b* is formed on the left side on the back end of the lever cover 13. The lever storage portion 13*b* is formed to have a home plate like shape in a plan view, and recessed downward. The lever cover 13 is configured to allow the rotation of the operation lever 31*m* when the lever cover 13 is placed at the unlocked position P2, and to block the rotation by covering the operation lever 31*m* located at the first position R1 (conduction/fixture position) when the lever cover 13 is placed at the locked position P1.

The opening 11*a* of the box body 11 described above is closed by the lid member 14.

The lid member 14 is formed in a substantially rectangular planar shape. A through hole 14*a* centering on the center axis C1 is formed at a back portion of the lid member 14, and an annular sliding surface 14*b* is provided around the through hole 14*a*. On the front side of the sliding surface 14*b*, a concave portion 14*c*, which is planar and longitudinal in the front-back direction, is formed at a position a little higher than the sliding surface 14*b*. Two fitting portions 14*d* are formed on both of the left end and at the right end of the concave portion 14*c*. These fitting portions 14*d* penetrate through the lid member 14 in the front-back direction (up-down direction). A leg portion 25*a* of the guide member 25 described below is fitted with the fitting portion 14*d* from above.

As described above, the power supply box 10 is configured by closing the opening 11*a* of the box body 11 by the lid member 14.

The temporary jointing mechanism 20 is incorporated into an upper surface of the lid member 14, as illustrated in FIGS. 1 and 2. As illustrated in FIG. 3, a slide base 21, a compression spring (spring member, biasing means) 22, a slide member 23, four lug members 24, and two guide members 25, substantially sequentially in this order from below, are combined to overlap one another and configure the temporary jointing mechanism 20.

Among them, the slide base 21 is planar and longitudinal in the front-back direction. On the front side and back side on the left surface and the right surface of the slide base 21, a total of four convex portions 21*a* are provided. A spring storage portion 21*b* being longitudinal in the front-back direction is formed at the center in the front-back direction and left-right direction of the slide base 21. The spring storage portion 21*b* penetrates through the slide base 21 in the up-down direction, and has a front wall surface 21*c* and a back wall surface 21*d*. The slide base 21 is secured to the concave portion 14*c* of the lid member 14 by the guide member 25 described below. In other words, the slide base 21 is stationary with respect to the lid member 14.

The compression spring 22 is stored in the spring storage portion 21*b* of the slide base 21. The compression spring 22 urges its front end to abut the front wall surface 21*c* of the spring storage portion 21*b*. A protruding portion 23*e* of the slide member 23 described below is inserted between the back end of the compression spring 22 and the back wall surface 21*d*. The compression spring member 22 biases the whole slide member 23 backward, through the protruding portion 23*e*.

In the slide member 23, a cam portion 23*a* that is planar and longitudinal in the front-back direction, an inclined portion 23*b* provided contiguously to the back end of the cam portion 23*a* and inclined downward toward the back, and an arc portion 23*c* provided contiguously to the lower end of the inclined portion 23*b* are formed integrally.

First to fourth four cam grooves (cam surfaces) 23*d* are provided ranging from the back end of the cam portion 23*a* that is close to the inclined portion 23*b* to the front end of the cam portion 23*a*, and the cam grooves penetrate through the cam portion 23*a* in the up-down direction. Among them, the first and third cam grooves 23*d* are inclined such that their back ends being located on the right and their front ends being located on the left. In contrast, the second and fourth cam grooves 23*d* are inclined such that their back ends being located on the left and their front ends being located on the right. A protruding portion 24*b* of the lug member 24 described below is engaged with these cam grooves 23*d* from above. On the center on the backside surface of the cam portion 23*a* in the front-back direction and left-right direction, a rectangular cuboid protruding portion 23*e* that protrudes downward is disposed. The protruding portion 23*e* is inserted between the back end of the compression spring 22 and the back wall surface 21*d* in the spring storage portion 21*b* of the slide base 21, as described above, and thus biased backward by the compression spring 22. This causes the whole slide member 23 to be biased backward.

In this case, the slide member 23 is configured such that the arc portion 23*c* lightly abuts a semicircular portion 31*i* of the plug 30 having a small diameter, before the protruding portion 23*e* biased by the compression spring 22 abuts the back wall surface 21*d*. Note that the position of the slide member 23 at this time is defined as a home position HP.

The lug member 24 and the guide member 25 described below block the whole slide member 23 from moving in the up-down direction, and the guide member 25 blocks the whole slide member 23 from moving in the left-right direction. As a result, only a sliding movement in the front-back direction (forward or backward) is allowed for the whole slide member 23.

An engagement concave portion 23*f* is formed on the left side surface of the inclined portion 23*b*. An engagement convex portion 31*k* of the plug 30 described below is engaged with the engagement concave portion 23*f*.

The arc portion 23*c* is formed in a substantially quarter ring shape. The arc portion 23*c* has an inner periphery surface 23*g* having the same shape as the shape of an outer periphery surface of the semicircular portion 31*i* of the plug 30 described below. The back end of the arc portion 23*c* is an abutting surface 23*h*, and a protruding portion 31*n* of the plug 30 described below is connected to and disconnected from the abutting surface 23*h*.

The whole slide member 23, including the cam portion 23*a*, the inclined portion 23*b*, and the arc portion 23*c* described above, abuts the plug 30 with a biasing force (being biased). In other words, the slide member 23 is held stationary, by causing the inner periphery surface 23*g* of the arc portion 23*c* to abut the semicircular portion 31*i* of the plug 30, before the protruding portion 23*e* biased by the compression spring 22 abuts the back wall surface 21*d* of the spring storage portion 21*b*. Note that the position of the slide member 23 at this time is defined as a home position HP.

The lug member 24 has a rectangular cuboid (plate like) shape. An inclined surface 24*a*, which is inclined downward toward the tip, is formed on the surface of inclined surface 24*a* at a tip portion directed outward, and a planar sliding surface 24*c* is formed on the back surface at the tip portion. In addition, a cylindrical protruding portion (cam follower) 24*b*, which protrudes downward, is provided at a substantially center portion on the back surface of the lug member 24. In this embodiment, the first to fourth four lug members 24 are provided in this order from the back side to the front side, with each protruding portion 24*b* being respectively engaged with the first to fourth cam grooves 23*d* of the slide member 23. At this time, the first and third lug members 24 are disposed in a state in which their inclined surfaces 24*a* at the tip portion are directed leftward, and the second and fourth lug members 24 are disposed in a state in which their inclined surfaces 24*a* at the tip portion are directed rightward.

Regarding the arrangement of the first to fourth four lug members 24 in the front-back direction, the spacing between the first and second lug members 24, and the spacing between the third and fourth lug members 24 are relatively narrow, whereas the spacing between the second and third lug members 24 is relatively wide. This arrangement can stabilize the posture of the power supply box device 1 being in a temporary jointing condition, in which the four lug members 24 are engaged with the wiring duct 5. In addition, if the overall center of gravity is placed between the second and third the lug members 24, in a condition in which the lighting fixture 6 is mounted to the power supply box device 1, then the posture of the power supply box 1 and the lighting fixture 6 in the temporary jointing state can be made more stable. Note that the number of the lug member 24 is not limited to four.

The two guide members 25 are mounted to the lid member 14 to cover the slide base 21, the slide member 23, and the lug member 24 from above. The guide member 25 is formed to have a shape of a U character opening substantially downward in a front view (the shape viewed from the front side). The leg portion 25*a* is formed at the lower end in a front portion on the left sidewall and at the lower end on the back end on the right sidewall of the guide member 25. In addition, a window portion 25*b* opening leftward, and a guide portion 25*c* extending rightward from the window portion 25*b* are formed on the front end portion of the guide member 25. On the other hand, a window portion 25*d* opening rightward, and a guide portion 25*e* extending leftward from the window portion 25*d* are formed on the back end portion of the guide member 25. In addition, a notch portion 25*f* is formed at the lower end at the center in the front-back direction on the left sidewall and on the right sidewall. In addition, a guide portion 25*g*, which guides the movement of the slide member 23 in the front-back direction, is formed on an inner surface of the guide member 25. When the width (dimension in the left-right direction) of the guide member 25 illustrated in FIG. 3 is defined as W3, the width W3 is set to satisfy a relation of W3<W2, where W2 is the width of the duct groove 5*a* of the wiring duct illustrated in FIG. 5. This setting enables a temporary jointing of the power supply box device 1 as described below, by inserting the guide member 25 into the duct groove 5*a*.

Each leg portion 25*a* of the guide member 25 is fitted with the fitting portion 14*d* of the lid member 14 from above. With this configuration, the guide member 25 causes the notch portion 25*f* to engage with the convex portion 21*a* of the slide base 21, and thus the slide base 21 is securely positioned with the concave portion 14*c* of the lid member 14. In addition, the guide member 25 guides a sliding movement of the slide member 23 in the front-back direction with respect to the slide base 21, by the guide portion 25*g*. Moreover, the guide member 25 guides a movement of a lug member in the left-right direction.

Note that the cam groove 23*d* of the slide member 23 described above, and the protruding portion 24*b* of the lug member 24 that engages with the cam groove 23*d* together configure a cam structure A. The cam structure A transforms a forward movement and a backward movement of the slide member 23 into a retraction and a protrusion of the lug member 24. In addition, the slide member 23 and the cam structure A together configure a retracting mechanism B. The retracting mechanism B causes the lug member 24 to retract from the protruding position T1 to the retracting position T2.

Next, the plug 30 is described below.

Figure 6:
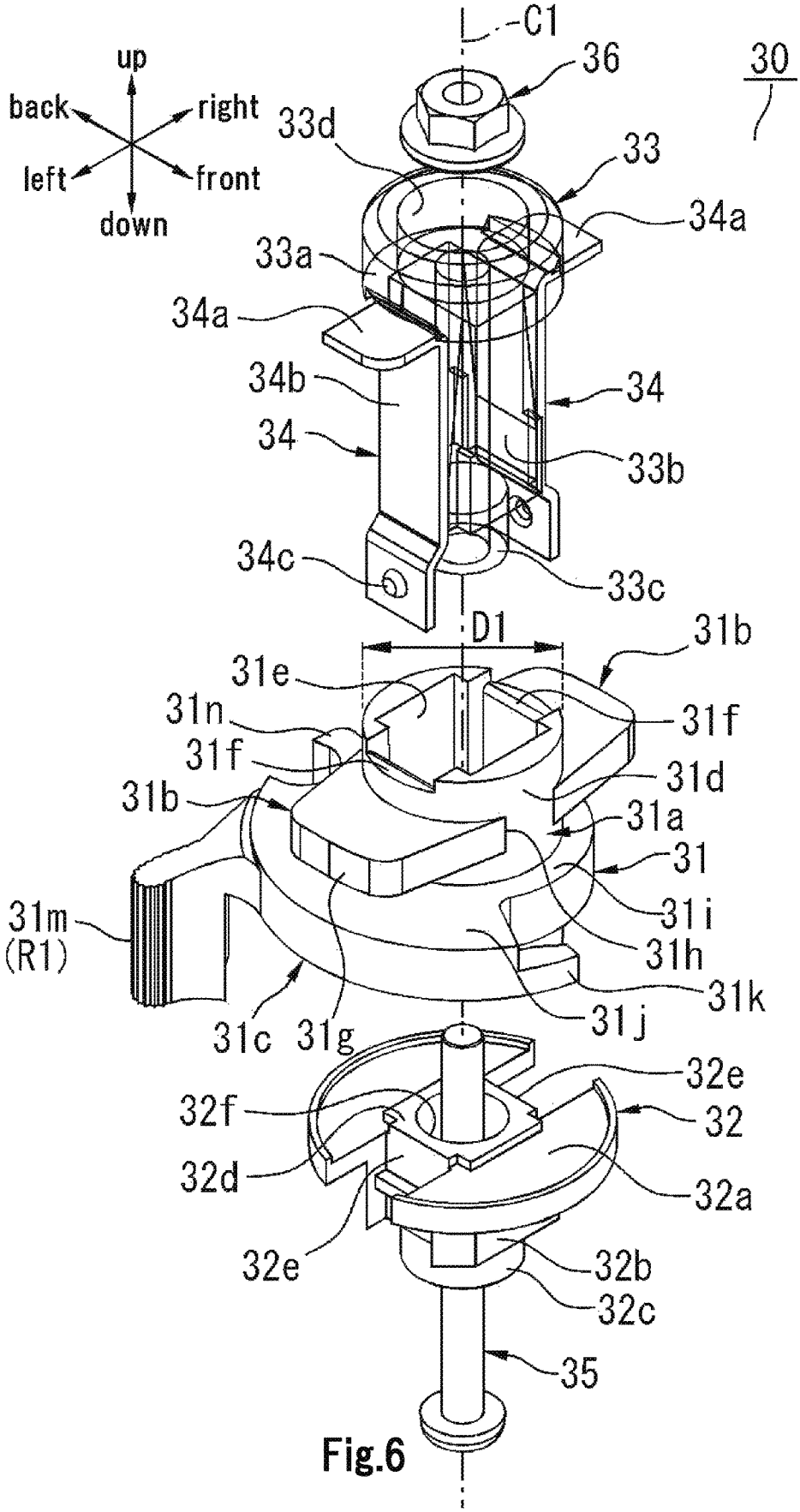

FIG. 6 is an exploded oblique view of the plug 30.

Figure 7:
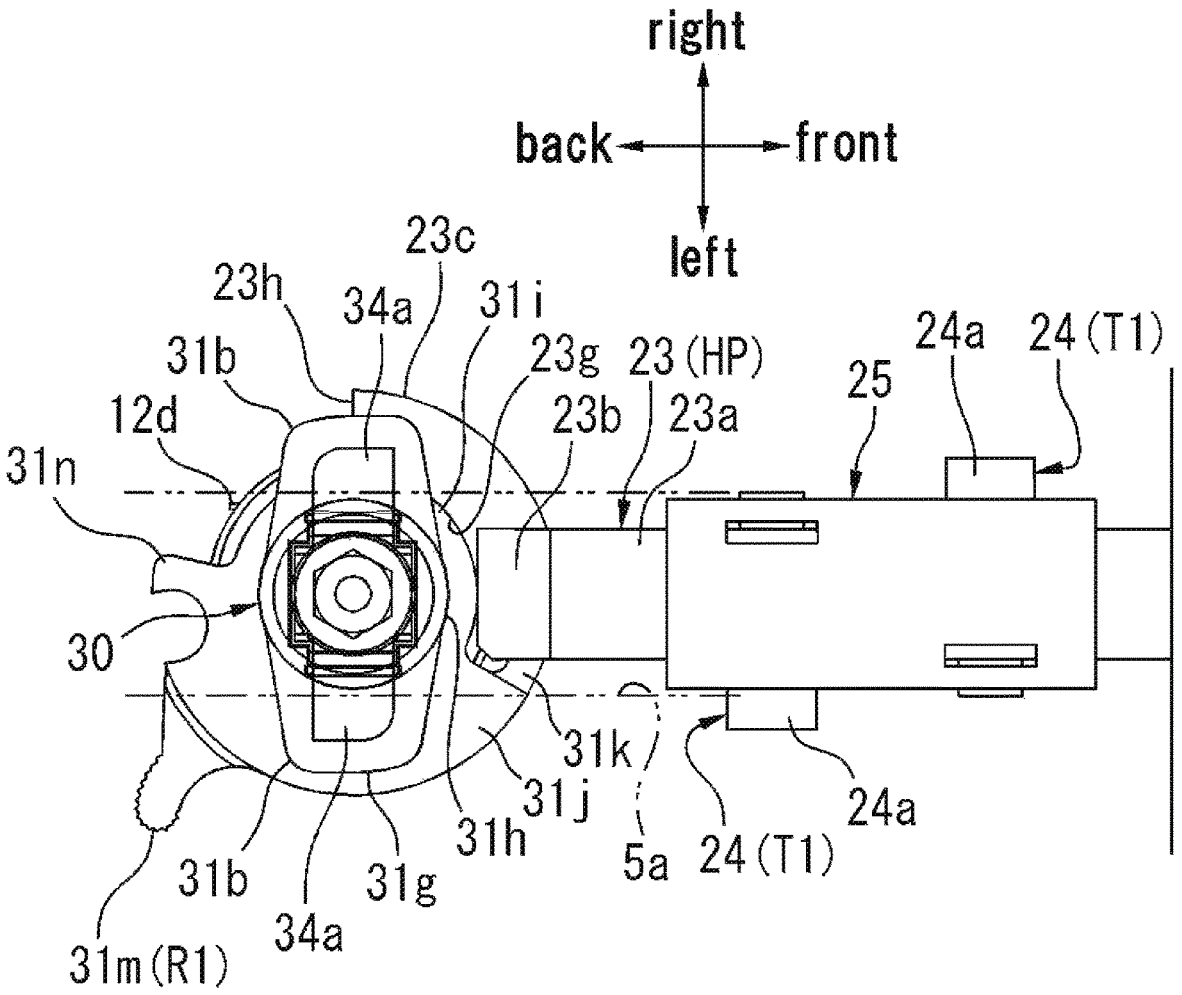

FIG. 7 is a plan view of the plug 30, the slide member 23, the lug member 24, the guide member 25, and the electrode) 2*d* of the box body 11, when the operation lever 31*m* is disposed at the first position R1. Note that other components are omitted in the drawing.

Figure 8:
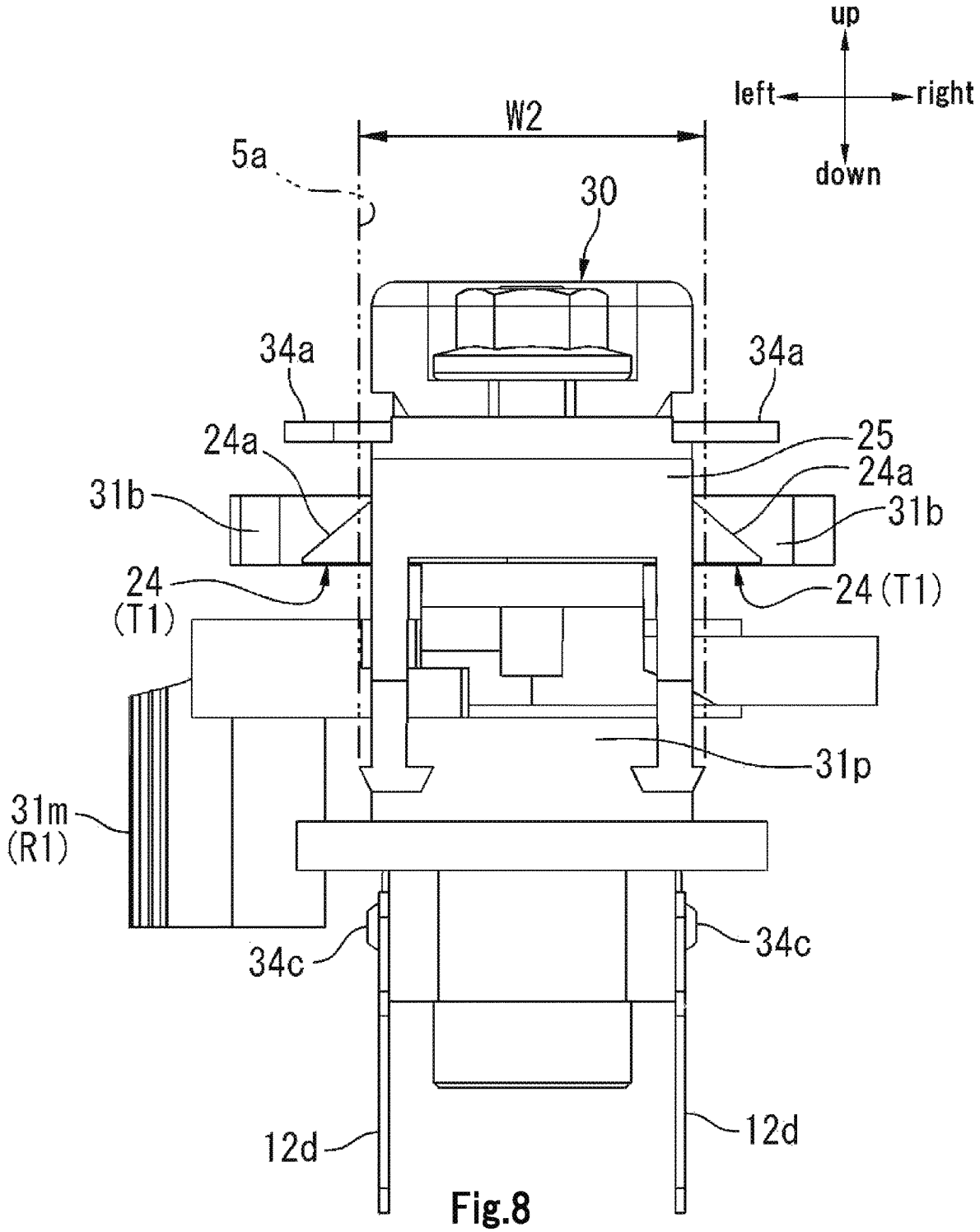

FIG. 8 is a front view thereof.

The plug 30 comprises the upper stopper 31, the lower stopper 32, the shaft 33, and two electrodes 34, as illustrated in FIG. 3, FIG. 6, FIG. 7, and these components are integrally assembled by a screw 35 that penetrates through the center axis C1 and, a nut 36.

In the upper stopper 31, a cylindrical portion 31*a*, a pair of engagement pieces 31*b*, and a brim portion 31*c* are formed.

Among them, the cylindrical portion 31*a* has a cylindrical outer periphery surface 31*d*. A through hole 31*e*, which has a substantially square shape in a plan view, penetrates through the center of the cylindrical portion 31*a* in the up-down direction. A notch portion 31*f*, with which a bent portion (wing portion) 34*a* of the electrode 34 is engaged, is formed on the right and left sides at the upper end of the cylindrical portion 31*a*. The diameter (outer diameter) D1 of the cylindrical portion 31*a* is set to be substantially the same as the width W3 of the guide member 25 described above, and a little smaller than the width W2 of the duct groove 5*a* of the wiring duct 5 (see FIG. 5).

The engagement piece 31*b* protrudes leftward and rightward from the outer periphery surface 31*d* of the cylindrical portion 31*a*. The shape of the engagement piece 31*b* is formed in a substantially isosceles trapezoid shape in a plan view. In other words, the engagement piece 31*b* is formed in a tapered shape. The size of the engagement piece 31*b* in the front-back direction gradually increases from a tip portion 31*g*, and becomes the maximum at the base end portion 31*h*, but does not exceed the diameter D1 of the cylindrical portion 31*a* even at the base end portion 31*h*. With this configuration, the engagement piece 31*b* of the plug 30 and the bent portion 34*a* of the electrode 34 can pass through the duct groove 5*a* of the wiring duct 5, when the operation lever 31*m* is located between the second position R2 (conduction/fixture release position) and the third position R3 (temporary-joint release position) as described below with reference to FIG. 9, FIG. 11. In other words, the position of the operation lever 31*m* that allows these components to pass through is not limited to a specific point, but has an appropriate margin. To have such a margin enables to obtain a rotation angle of the operation lever 31*m* that causes the slide member 23 to move forward in order to release the temporary jointing state.

The brim portion 31*c* comprises a substantially right half semicircular portion 31*i* having a small diameter, and a substantially left half semicircular portion 31*j* having a large diameter. The semicircular portion 31*i* is formed to have a curvature radius that is the same as the curvature radius of the inner periphery surface 23*g* of the arc portion 23*c* of the slide member 23 described above. The semicircular portion 31*i* abuts the inner periphery surface 23*g* with a light contact pressure. On the other hand, the engagement convex portion 31*k* protruding in a radial direction is provided on the front end portion of the semicircular portion 31*j*, and the engagement convex portion 31*k* is engaged with the engagement concave portion 23*f* of the slide member 23 described above. With this configuration, the slide member 23 is blocked from moving forward. In addition, the operation lever 31*m* is provided on the left side and the protruding portion 31*n* is provided on the right side, on the front end portion of the semicircular portion 31*j*. The operation lever 31*m* is formed so as to protrude in a radial direction from the semicircular portion 31*j* and extend downward. The operation lever 31*m* is disposed in the first position R1, and covered by the lever cover 13 that is disposed in the locked position P1. Note that, if the whole configuration of the plug 30 from which operation lever 31*m* is excluded is considered as a plug body, it can be said that the operation lever 31*m* is formed so as to protrude in a radial direction from the plug body and extend downward.

A portion 31*p* (see FIG. 8) of the upper stopper 31 located below the brim portion 31*c* in the cylindrical portion 31*a* is inserted into the through hole 14*a* of the lid member 14 illustrated in FIG. 3, and the back surface of the brim portion 31*c* is disposed on the sliding surface 14*b* of the lid member 14.

In the lower stopper 32, a flange portion 32*a*, a rectangular prism portion 32*b*, and a boss portion 32*c* are formed.

A substantially square shaped step portion 32*d* is formed on the center of the flange portion 32*a*. The step portion 32*d* is fitted with the through hole 31*e* of the upper stopper 31. In addition, a notch portion 32*e* is formed both on the left and right sides of the flange portion 32*a* and the rectangular prism portion 32*b*. A protrusion 34*c* at the lower end of the electrode 34 is disposed in the notch portion 32*e*. The boss portion 32*c* is inserted into the through hole 12*c* in the box body 11 illustrated in FIG. 3.

The shaft 33 comprises a head portion 33*a*, a rectangular prism portion 33*b*, and a boss portion 33*c*, in this order sequentially from above. A nut 36 is placed in a concave portion 33*d* of the head portion 33*a*. The head portion 33*a* interposes the vicinity of the bent portion 34*a* of the electrode 34, between the lower end of the head portion 33*a* and the notch portion 31*f* of the upper stopper 31 described above. The rectangular prism portion 33*b* has a surface on which the electrode 34 is to be mounted, and the surface is inclined such that an upper portion is located inner, and thus a gap is formed between itself and the back surface side of the electrode 34. The boss portion 33*c* is inserted into a through hole 32*f* at the center of the step portion 32*d* of the lower stopper 32.

The electrode 34 comprises a bent portion 34*a* bent outward at the upper end, a middle portion 34*b* extending downward, and the protrusion 34*c* at the lower end. The electrode 34 is disposed such that the middle portion 34*b* is interposed between the through hole 31*e* of the upper stopper 31 and the rectangular prism portion 33*b* of the shaft 33. As a result, as illustrated in FIG. 3, the bent portion 34*a* protrudes outward in the left-right direction, as same as the engagement piece 31*b* described above, and the protrusion 34*c* is exposed toward the left-right direction.

The whole plug 30 described above is supported so as to be capable of being rotated forward and backward, by the lid member 14, centering on the center axis C1.

Note that the temporary jointing mechanism 20 described above and the plug 30 configures a mounting and removing apparatus C.

Next, the operation of the power supply box device 1 having the configuration described above is described below.

Figure 9:
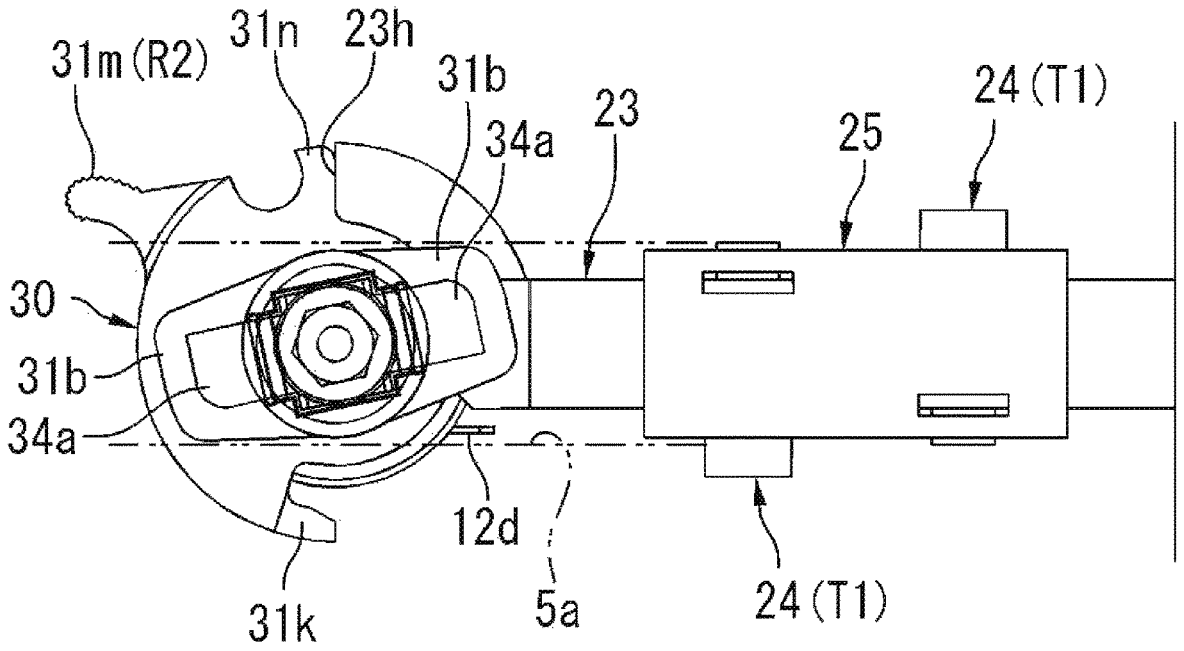
Figure 10:
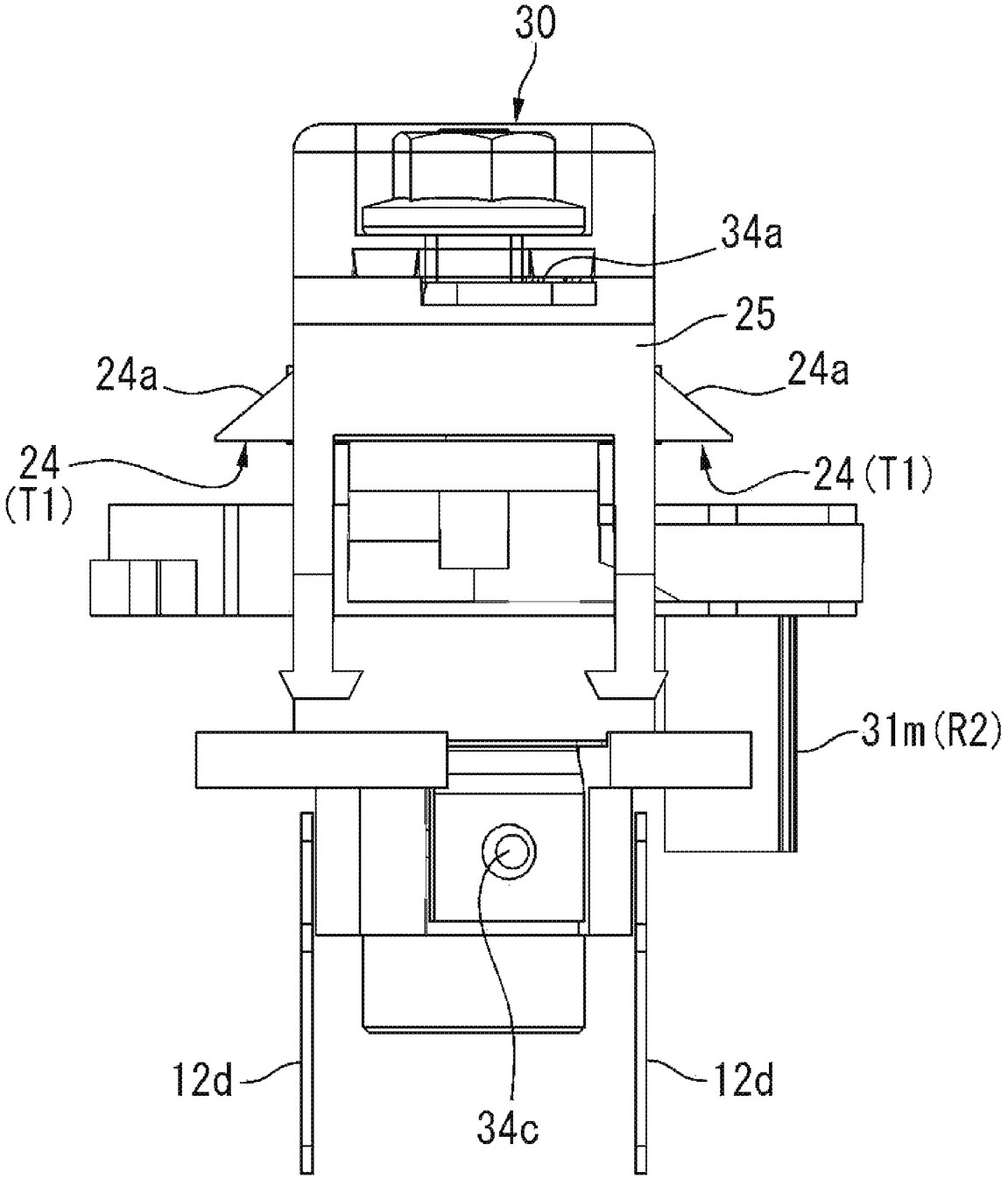

FIG. 9 is a plan view of the plug 30, the slide member 23, the lug member 24, the guide member 25, and the electrode 12*d* of the box body 11, when the operation lever 31*m* is disposed at the second position R2. FIG. 10 is a front view thereof.

Figure 11:
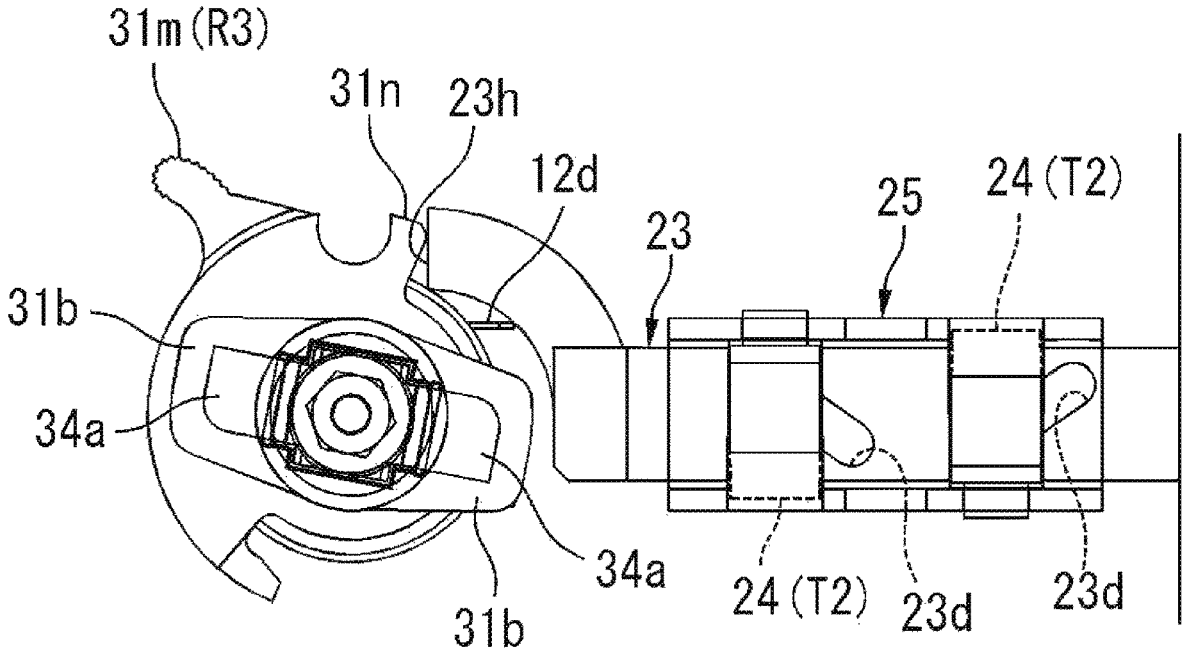
Figure 12:
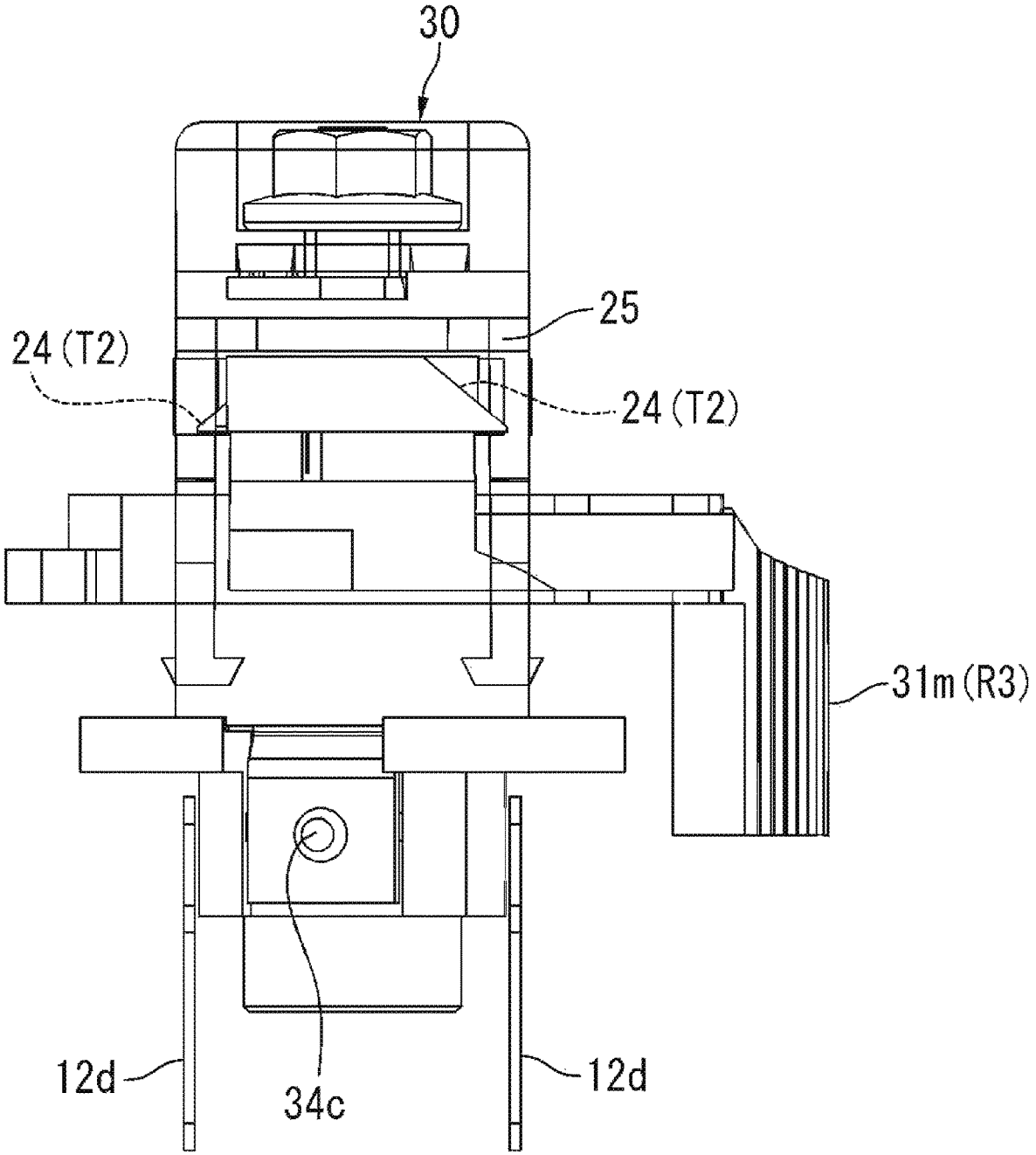

FIG. 11 is a plan view of the plug 30, the slide member 23, the lug member 24, the guide member 25, and the electrode 12*d* of the box body 11, when the operation lever 31*m* is disposed at a third position R3. FIG. 12 is a front view thereof.

Figure 13:
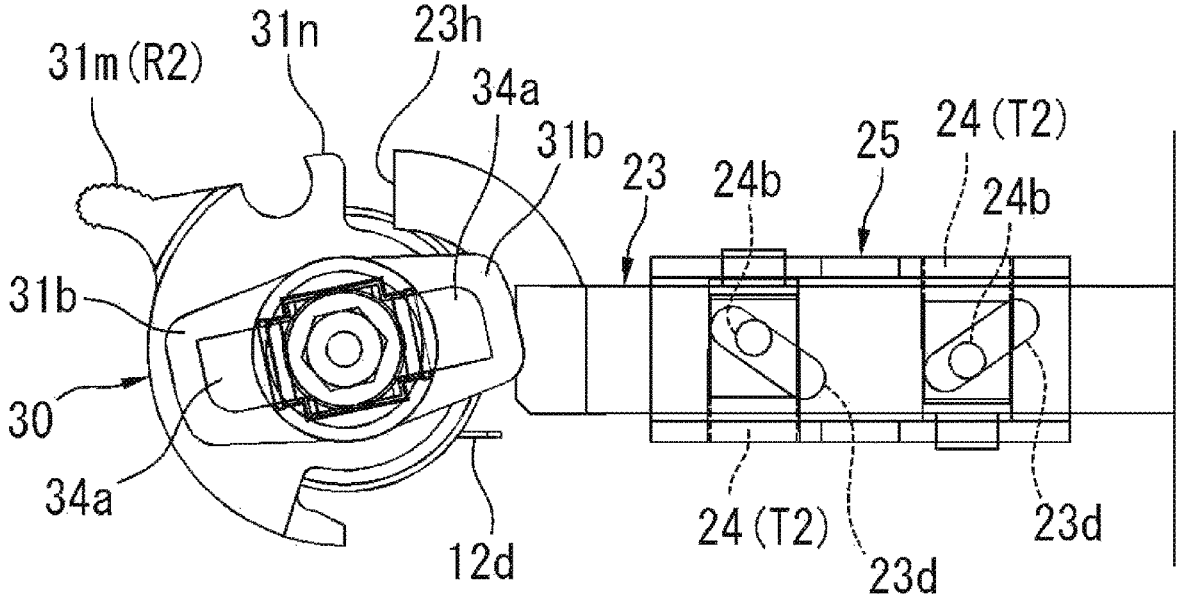
Figure 14:
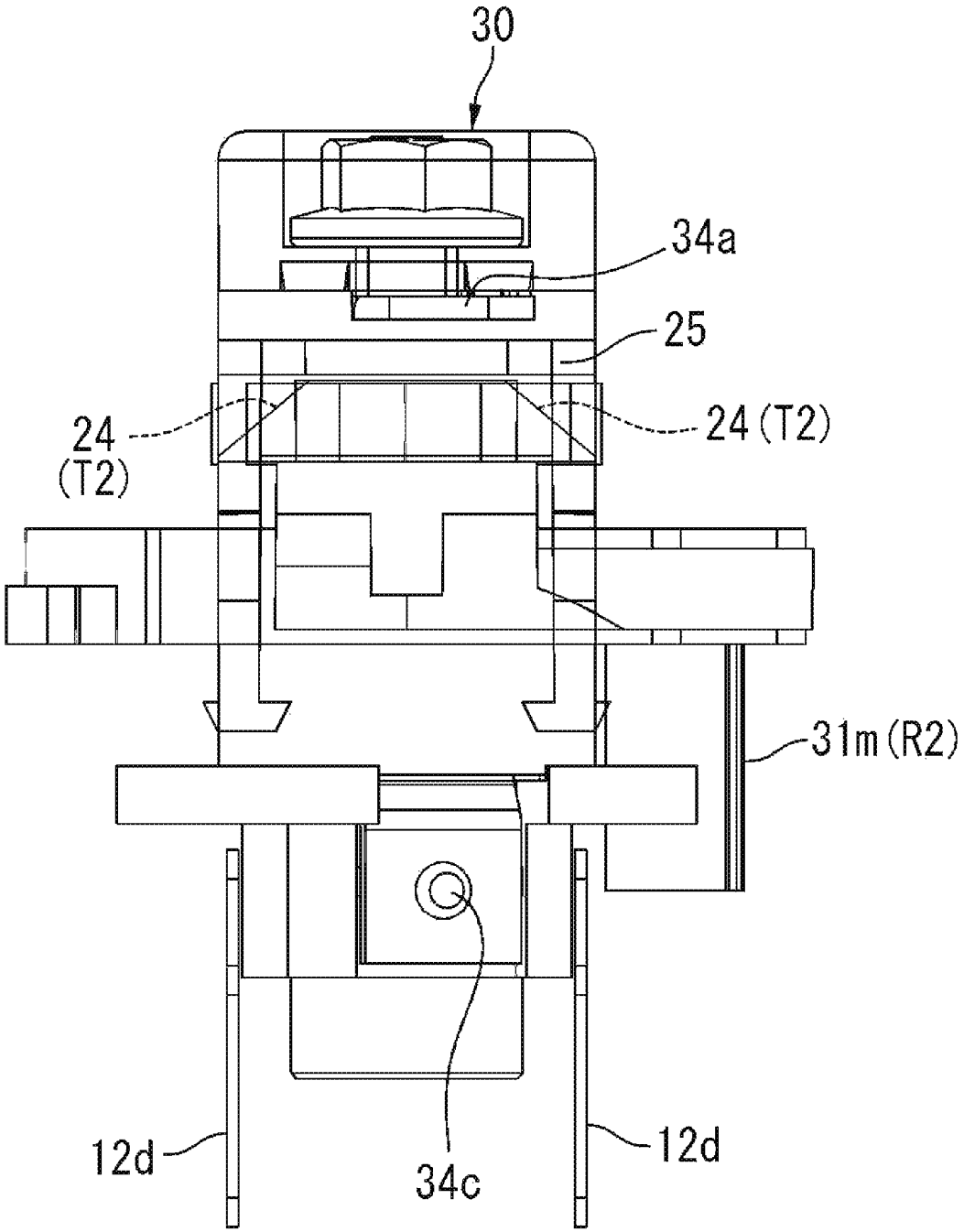

FIG. 13 is a plan view of the plug 30, the slide member 23, the lug member 24, the guide member 25, and the electrode 12*d* of the box body 11, when the operation lever 31*m* is disposed at the second position R2 and the lug member 24 is disposed at the retracting position T2. FIG. 14 is a front view thereof.

At first, a case is described in which an operator removes the power supply box device 1 from the wiring duct 5.

Each component of the power supply box device 1 is disposed in the home position HP as illustrated in FIG. 1, FIG. 7, FIG. 8, in a condition where the power supply box device 1 is mounted to the wiring duct 5 and electrically connected and mechanically fixed with the wiring duct 5.

At this time, the operation lever 31*m* is disposed in the first position R1, and covered by the lever cover 13 that is disposed in the locked position P1.

Corresponding to the first position R1 of the operation lever 31*m*, the bent portion 34*a* of the electrode 34 and the engagement piece 31*b* are directed in a substantially left-right direction. In this condition, the bent portion 34*a* of the electrode 34 contacts the conductive plate (not shown) in the wiring groove 5*b* and thus electrically couples the wiring duct 5 and the power supply box device 1. In addition, the engagement piece 31*b* is directed in the left-right direction, as indicated by a double-dashed chain line in FIG. 5, and interposes the rail portion 5*c* of the wiring duct 5 from above and below, between itself and the brim portion 31*c*. Under this condition, the whole power supply box device 1 is secured so as not to be able to move with respect to the wiring duct 5.

The slide member 23 is disposed in the home position HP, and the lug member 24 is disposed in the protruding position T1. The protruding lug member 24 engages with the wiring duct 5, and keeps the temporary jointing state.

Subsequently, the lever cover 13 is moved to the unlocked position P2, and the operation lever 31*m* is rotated backward and moved to the second position R2 as illustrated in FIG. 9, FIG. 10.

Corresponding to the second position R2 of the operation lever 31*m*, the bent portion 34*a* of the electrode 34 is directed in a substantially front-back direction, and separated from the conductive plate, and thus the electrical connection between the wiring duct 5 and the power supply box device 1 is released. In addition, the engagement piece 31*b* is directed in a substantially front-back direction, and thus the mechanical fixture of the power supply box device 1 with respect to the wiring duct 5 is released.

In addition, the slide member 23 is in contact only with the protruding portion 31*n* of the plug 30, and thus continuously keeps its home position HP, and the lug member 24 continuously keeps the protruding position T1 and thus keeps the temporary jointing state.

At this time, the plug 30 is in a state in which it can be removed from the wiring duct 5. However, since the temporary jointing state is kept by the lug member 24 as described above, the power supply box device 1 will not drop.

Subsequently, the operation lever 31*m* is rotated backward, and moved to the third position R3 as illustrated in FIG. 11, FIG. 12.

Corresponding to the third position R3 of the operation lever 31*m*, the bent portion 34*a* of the electrode 34 and the engagement piece 31*b* are directed in the front-back direction, substantially similarly to the case when the operation lever 31*m* described above is in the second position R2. In other words, the electrical connection and mechanical fixture are kept released.

In addition, the slide member 23 is pushed by the protruding portion 31*n* of the plug 30, and moves forward. This causes the lug member 24 to be disposed in the retracting position T2, with its tip portion being retracted in the guide member 25, and thus the temporary jointing state is released.

The power supply box device 1 can be removed from the wiring duct 5 when the operation lever 31*m* is disposed in the third position R3 position.

Next, a case is described in which an operator mounts the power supply box device 1 to the wiring duct 5.

When the operator lets go of the operation lever 31*m* of the power supply box device 1 that is removed from the wiring duct 5, the compression spring 22 causes the operation lever 31*m* to move backward, and thus the lug member 24 is disposed in the protruding position T1. In addition, by the backward movement of the operation lever 31*m*, the protruding portion 31*n* rotates forward, and thus the operation lever 31*m* moves to the second position R2 illustrated in FIG. 9.

As a result, the power supply box device 1 will be mounted to the wiring duct 5, in a condition in which the operation lever 31*m* is disposed in the second position R2 and the lug member 24 is disposed in the protruding position T1, as illustrated in FIG. 9, FIG. 10.

The power supply box device 1 is held, for example, by the operator with one hand, and the bent portion 34*a* of the electrode 34 of the plug 30, the engagement piece 31*b*, and the guide member 25 are inserted into the duct groove 5*a* of the wiring duct 5. At this time, the bent portion 34*a* of the electrode 34 and the engagement piece 31*b* are directed in a substantially front-back direction, and the lug member 24 is retracted to the retracting position T2 illustrated in FIG. 13, with the inclined surface 24*a* abutting a portion of the wiring duct 5, and thus its insertion is enabled. After the insertion, the lug member 24 returns to the protruding position T1, and engages with the wiring duct 5, resulting in a temporary jointing state.

In the temporary jointing state, the lug member 24 will not be retracted to the retracting position T2, unless a retracting action is performed. In addition, the sliding surface 24*c* on the back surface at a tip of the lug member 24 is disposed onto the rail portion 5*c* of the wiring duct 5 from above. As a result, the operator does not need to support the self-weight of the power supply box device 1 in the temporary jointing state, and thus can readily move and position the power supply box device 1 along the wiring duct 5.

After the positioning, if the operation lever 31*m* is rotated forward from the second position R2 to the first position R1, then the bent portion 34*a* of the electrode 34 and the engagement piece 31*b* are directed in the left-right direction, and an electrical connection and a mechanical fixture of the power supply box device 1 with respect to the wiring duct 5 can be made.

Effects and advantages of the power supply box device 1 having the configuration described above are summarized below.

The power supply box device 1 can be engaged with the wiring duct 5 by a simple action, for example, in which an operator holds up the power supply box device 1 with one hand and then inserts the guide member 25 into the duct groove 5*a* of the wiring duct 5, which causes once retracted lug member 24 to protrude again. In this temporary jointing state, the lug member 24 can support the self-weight of the power supply box device 1 without deformation, and thus even if the operator lets go of the power supply box device 1, the power supply box device 1 will not drop. Therefore, the operator can readily move and position the power supply box device 1 along the wiring duct 5 with one hand. Note that a case, in which the lighting fixture 6 is previously mounted to the power supply box device 1, can also be done similarly to this case.

The lug member 24 can be retracted in a simple configuration, for example, in which an inclined surface 24*a* having a downward inclination is provided at the tip portion of the lug member 24.

The lug member 24 can be retracted through the cam structure A, by causing the slide member 23 to move forward against the biasing force of the compression spring (spring member, biasing means) 22. By this operation, the engagement of the lug member 24 with respect to the wiring duct 5 can be released. In other words, the temporary jointing of the power supply box device 1 with respect to the wiring duct 5 can be released.

The lug member 24 being capable of moving in the left-right direction causes the convex protruding portion (cam follower) 24*b* to be engaged with the inclined cam groove (cam surface) 23*d* of the slide member 23, and thus can be retracted or protruded corresponding to a forward or a backward movement of the slide member 23.

The lug member 24 has the planar sliding surface 24*c* that slides on the rail portion 5*c* of the wiring duct 5, and thus the power supply box device 1 can be readily moved along the wiring duct 5.

The retracting mechanism B can release the engagement of the lug member 24 with the wiring duct 5, by causing the lug member 24 to retract, in cooperation with the backward rotation of the plug 30 that makes an electrical connection and a mechanical fixture of the power supply box device 1 with respect to the wiring duct 5. By this operation, the temporary jointing of the power supply box device 1 with respect to the wiring duct 5 is released, and thus the power supply box device 1 can be removed from the wiring duct 5. In other words, the backward rotation of the plug 30 enables both of the release of the electrical connection and mechanical fixture of the power supply box device 1 and the release of the temporary jointing.

The backward rotation of the plug 30 from the second position R2 to the third position R3 causes the lug member 24 to retract and release its engagement with the wiring duct 5, and thus the temporary jointing is released. In other words, the temporary jointing is released and the removal of the power supply box device 1 from the wiring duct 5 can be enabled, only after the plug 30 is rotated backward from the first position R1 to the second position R2 and thus the electrical connection is released. Therefore, the power supply box device 1 can be removed electrically safely.

When the plug is located in the second position R2, electrical connection is not made even when the power supply box device 1 is mounted to the wiring duct 5, and thus the power supply box device 1 can be mounted to the wiring duct 5 electrically safely. After the power supply box device 1 is mounted, an electrical connection can be obtained by rotating the plug 30 forward from the second position R2 to the first position R1.

The lever cover 13, when disposed in the locked position P1, covers the operation lever 31*m* at a predefined position, and can prevent the operation lever 31*m* from being visible from outside. Therefore, design can be improved, and an unwanted operation (erroneous operation) of the operation lever 31*m* can be prevented.

The predefined position of the operation lever 31*m* is set to the first position R1, in which an electrical connection and a mechanical fixture between the wiring duct 5 and the power supply box device 1 are made. As a result, the lever cover 13 in the locked position P1 covers the operation lever 31*m* being disposed in the first position R1, and blocks the rotation. In other words, the release of the electrical connection or the release of the mechanical fixture between the wiring duct 5 and the power supply box device 1 can be prevented.

An operator can confirm that an electrical connection and a mechanical fixture between the wiring duct 5 and the power supply box device 1 are surely made, by the fact that lever cover 13 can be moved up to the locked position P1.

According to the power supply box device 1 described above, both of the temporary jointing mechanism 20 and the plug 30 for mounting the power supply box device 1 to the wiring duct 5 and removing it from the wiring duct 5 are incorporated into the lid member 14. Therefore, the power supply box 10 can adapt to various wiring ducts 5, e.g., having a different configuration, size, etc., for example by changing the design of the temporary jointing mechanism 20 and the plug 30 including the lid member 14, but without changing the design of the power supply box 10.

In the power supply box device 1 described above, the lug member 24 is biased by the compression spring 22 in a protruding direction, through the slide member 23. When the lug member 24 is disposed in the protruding position T1, no biasing force acts on the lug member 24. However, if the lug member 24 is moved even slightly from the protruding position T1 toward the retraction position T2, a biasing force immediately acts on the lug member 24 toward the protruding position T1. Alternatively, for example, a stopper (not shown) that causes the lug member 24 to be positioned at the protruding position T1 may be provided, such that the compression spring 22 urges the stopper to push the lug member 24 through the slide member 23. In this case, the lug member 24 is disposed in the protruding position T1, with the lug member 24 being biased, in which a biasing force acts on the lug member 24 in the protruding direction. The present invention includes both of the case described above, in which a biasing force does not act on the lug member 24 being disposed in the protruding position T1, and a case in which a biasing force acts on the lug member 24 being disposed in the protruding position T1.

Embodiment 2

The power supply box device 2 to which the present invention according to Embodiment 2 is applied is described below, with reference to FIG. 15 and FIG. 16.

Figure 15:
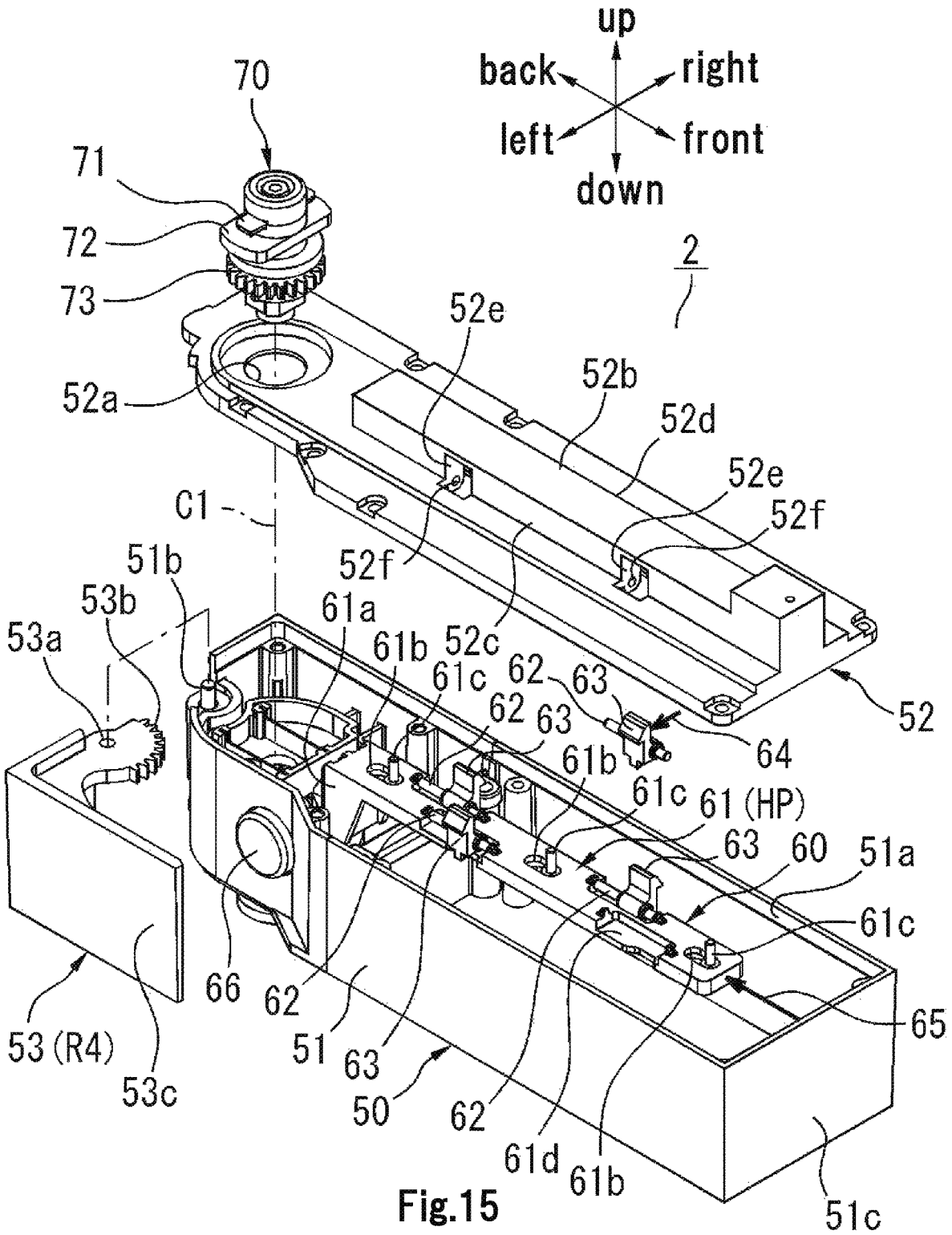
FIGS. 15 and 16 are diagrams illustrating a power supply box device 2 of Embodiment 2.

FIG. 15 is an oblique view of the power supply box device 2.

Figure 16:
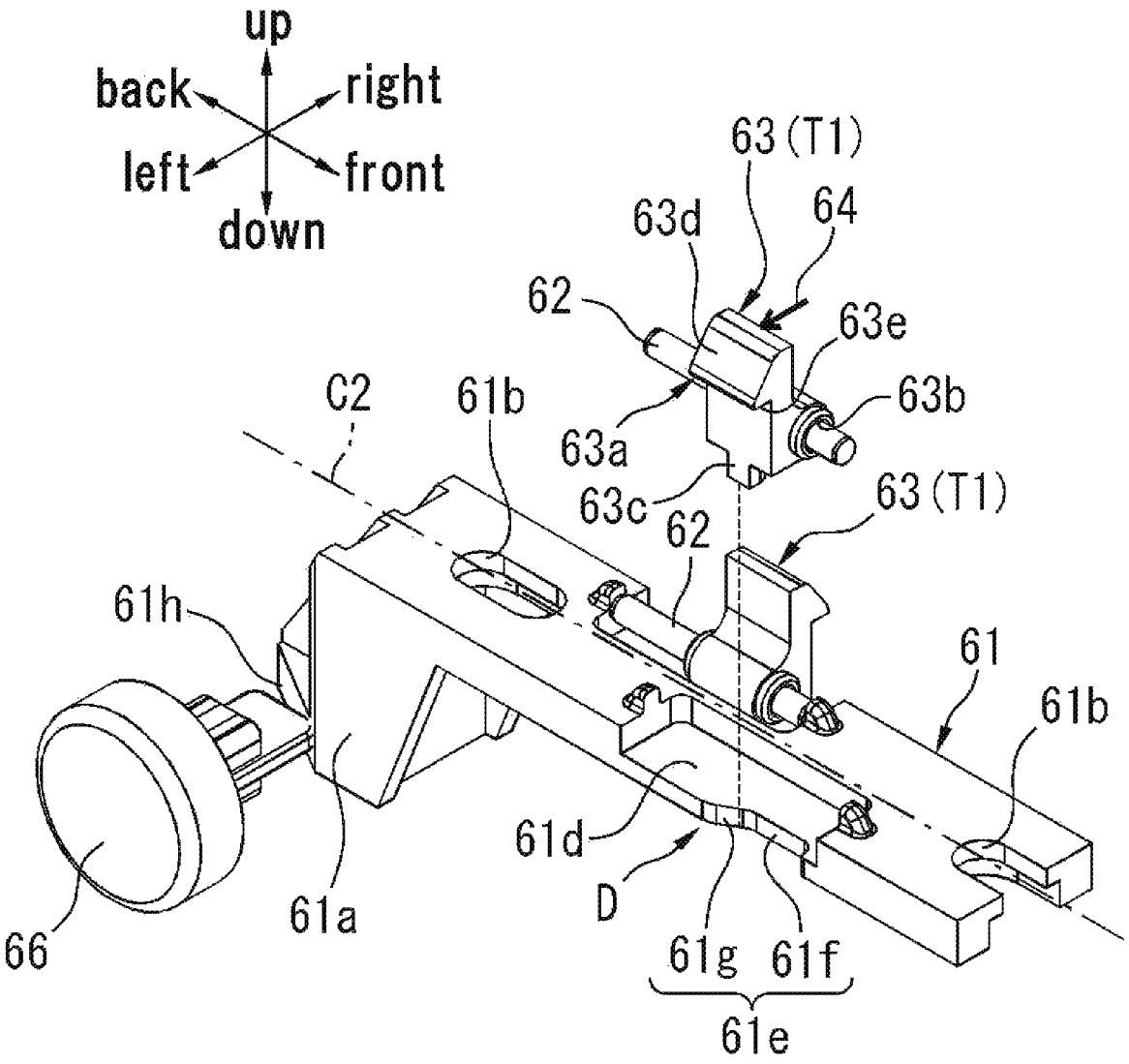

FIG. 16 is an exploded oblique view of a portion of the power supply box device 2.

In the description below, it is assumed that the "front, back, left, right, up, down" in FIG. 15 and FIG. 16 indicated by arrows respectively correspond to the "front, back, left, right, up, down" of the power supply box device 2 or the wiring duct 5.

The power supply box device 2 comprises a power supply box 50, a temporary jointing mechanism 60, and a plug 70.

Among them, the power supply box 50 comprises a box body 51 having an opening 51*a* formed at its upper portion, and a lid member 52 for closing the opening 51*a*.

A through hole 52*a* is formed on a back end portion of the lid member 52 for rotatably supporting the plug 70. A cover portion 52*b* is formed so as to extend from a portion slightly front of the through hole 52*a* to the front end of the lid member 52. The cover portion 52*b* has a rectangular cuboid shape that is longitudinal in the front-back direction, and is provided to protrude upward, and its inside opens downward. The cover portion 52*b* covers the temporary jointing mechanism 60 from above.

Two window portions 52*e* are formed, respectively in a left sidewall 52*c* and in a right sidewall 52*d* of the cover portion 52*b* (the window portions 52*e* in the right sidewall 52*d* are not shown). Note that the two window portions 52*e* in the left sidewall 52*c* are formed in positions slightly more front than the two window portions 52*e* in the right sidewall 52*d*. In each of the window portions 52*e*, a pair of bearing portions 52*f* are provided, which are opposing each other in the front-back direction. An axis member 62 described below penetrates through the bearing portion 52*f*.

An operation lever 53 is disposed on the left side on the back end of the box body 51. The operation lever 53 is formed in a plate-like shape having a shape of L character in a plan view. On a right end portion of the operation lever 53, small holes 53*a* are formed at two, upper and lower, positions. These small holes 53*a* are engaged with an axis portion 51*b* being in the up-down direction in the box body 51. A gear portion 53*b* is formed on the right end on the back end of the operation lever 53. The whole operation lever 53 is supported so as to be capable of being rotated (swung) by the axis portion 51*b*, and is moved between a closing position R4 illustrated in the drawing, and an opening position being rotated clockwise approximately 90 degrees from the closing position R4.

The temporary jointing mechanism 60 comprises a slide member 61, four axis members 62, four lug members 63, four first compression springs (spring members, biasing means) 64, a second compression spring (spring member) 65, and a temporary-joint release button 66. Note that the first compression spring 64 and the second compression spring 65 are each indicated by an arrow.

Among them, the slide member 61 is planar and longitudinal substantially in the front-back direction, and has an abutting portion 61*a* bent downward on the back end. A total of three guide grooves 61*b* are formed in the slide member 61, one in a back end portion, one in a middle portion, and one in a front end portion. The guide groove 61*b* has an elongated circle shape that is longitudinal in the front-back direction. A bolt 61*c* penetrates through the guide groove 61*b*. The bolt 61*c* has a head portion (not shown) having a diameter greater than the groove width of the guide groove 61*b*, and causes the head portion to abut the back surface of the slide member 61, and the bolt 61*c* penetrates through the guide groove 61*b* from below, and its tip (upper end) is screwed into the lid member 52. With this configuration, the whole slide member 61 is supported by the lid member 52, so as to be capable of moving in the front-back direction through the bolt 61*c*.

Two concave portions 61*d*, being longitudinal in the front-back direction, are formed both on the left end side and on the right end side, and thus a total of four concave portions 61*d* are formed, in the surface of the slide member 61. As illustrated in FIG. 16, a notch portion 61*e* recessed inward is provided in the concave portion 61*d*. In the notch portion 61*e*, a stopper surface 61*f* extending substantially in the front-back direction, and a cam surface 61*g* inclined outward from the back end of the stopper surface 61*f* are formed.

The axis member 62 is secured to the notch portion 61*e* of the slide member 61 described above, directed in the front-back direction. The axis member 62 is loosely fitted, in the front-back direction, with the bearing portion 52*f* of the window portion 52*e* of lid member 52 described above.

If the center in the width direction of the slide member 61 is defined as a reference line C2, and a portion nearer to the reference line C2 is defined as inner side, and a portion farther from the reference line C2 is defined as outer side, then the lug member 63 comprises a hook portion 63*a* provided at an upper portion of the lug member 63 and directed outward, and a cylindrical portion 63*b* provided at an inner and lower portion of the lug member 63 and directed in the front-back direction, and a protruding portion 63*c* provided outside of the lower portion of the lug member 63 and directed downward. The protruding portion 63*c* and the cam surface 61*g* described above configure a cam structure D.

An inclined surface 63*d* is formed on the upper surface of the hook portion 63*a*, and a sliding surface 63*e* formed on the lower surface. The inclined surface 63*d* is inclined such that an outer portion thereof is located lower. The sliding surface 63*e* engages with the rail portion 5*c* (see FIG. 5) of the wiring duct 5.

The cylindrical portion 63*b* is loosely fitted, in the front-back direction, with the axis member 62 described above. As a result, the lug member 63 is capable of swinging between the outer protruding position T1 and the inner retracting position (not shown), with respect to the axis members 62 that is in a stationary state, and is also capable of relatively moving in the front-back direction. Note that the angle the lug member 63 swings between the protruding position T1 and the retracting position is small, and thus it can be said that the hook portion 63*a* moves in a substantially left-right direction.

When the slide member 61 is located at the home position HP illustrated in FIG. 15 and FIG. 16, the protruding portion 63*c* abuts the stopper surface 61*f* and is stationary. At this time, the lug member 63 takes an uprising posture, with the hook portion 63*a* being located upward.

The first compression spring 64 is provided on the back side (inner side) of each the lug member 63. In the example illustrated in FIG. 16, the first compression spring 64 urges its tip portion to abut the back side of the hook portion 63*a* of the lug member 63, and causes its base end portion to abut an inner surface the right sidewall 52*d* in the cover portion 52*b* of the lid member 52 illustrated in FIG. 15. The lug member 63 is biased outward by the first compression spring 64, and becomes stationary and takes an uprising posture by causing the protruding portion 63*c* to abut the stopper surface 61*f*.

The lug member 63 causes the hook portion 63*a* to protrude from the window portion 52*e* or to be retracted, in a condition in which the movement of the lug member 63 in the front-back direction is restricted (blocked) by the window portion 52*e* of the lid member 52.

The second compression spring 65 is provided on the front end of the slide member 61. The compression spring 65 urges its tip portion to abut the front end of the slide member 61, and urges its base end portion to abut an inner surface of a back wall surface 51*c* of the box body 51. The slide member 61*b* eing biased backward by the second the compression spring 65 abuts the temporary-joint release button 66, and is disposed in the home position HP illustrated in FIG. 15.

The slide member 61 is moved forward when the temporary-joint release button 66 is pressed down. The slide member 61 comprises an abutting surface 61*h* at the lower end of the back end of the abutting portion 61*a*, as illustrated in FIG. 16. The abutting surface 61*h* is inclined such that its back end portion is located inner. With this configuration, when the temporary-joint release button 66 is pressed rightward, the tip portion of the temporary-joint release button 66 pushes the abutting surface 61*h* and causes the whole slide member 61 to move forward. In response to this movement, the cam surface 61*g* of the slide member 61 pushes the protruding portion 63*c* of the lug member 63 outward. This causes the hook portion 63*a* to fall inner side and be retracted, centering on the axis member 62. This means that the engagement of the lug member 63 with the wiring duct 5 (see FIG. 5) is released, and the temporary jointing is released.

The plug 70 comprises an electrode 71, an engagement piece 72, and a gear portion 73, as illustrated in FIG. 15, and is supported by the through hole 52*a* of the lid member 52 so as to be capable of being rotated forward and backward. The gear portion 73 is engaged with the gear portion 53*b* of the operation lever 53 of the box body 51 described above.

The power supply box device 2 described above is secured to the wiring duct 5 (see FIG. 5) in the state illustrated in FIG. 15. At this time, the lug member 24 is disposed in the protruding position T1, and engages with the wiring duct 5, and a temporary jointing state is obtained. In addition, the electrode 71 and the engagement piece 72 of the plug 70 are directed in a substantially left-right direction, and an electrical connection and a mechanical fixture are made. In addition, the operation lever 53 is disposed at the closing position R4, and covers the temporary-joint release button 66. As a result, an erroneous operation of the temporary-joint release button 66, for example by the temporary-joint release button 66 being inadvertently touched by an operator, can be prevented.

When the power supply box device 2 is to be removed from the wiring duct 5, the operation lever 53 is rotated backward (clockwise in the drawing) approximately 90 degrees. By this rotation, the electrode 71 and the engagement piece 72 of the plug 70 are directed in a substantially front-back direction, and thus the plug 70 can be removed. Note that, even at this point, the temporary jointing state is still maintained.

Subsequently, the temporary-joint release button 66 is pressed down. In response to the pressed button, the slide member 61 moves forward, and the lug member 63 is retracted to the retracting position, and thus the temporary jointing state is released. This enables the whole power supply box device 2 to be removed.

When the power supply box device 2 is to be mounted to the wiring duct 5, similarly to the lug member 24 of Embodiment 1, the lug member 63 abuts a portion of the wiring duct 5 and is retracted, and then protrudes after it passes the portion, and thus a temporary jointing state can be created.

According to the present invention, the engagement and the release of the engagement with respect to the wiring duct 5 can be done by a swinging action of the lug member 63. Therefore, by setting the distance from the cylindrical portion 63*b* to the hook portion 63*a* of the lug member 63 to be longer than the distance from the cylindrical portion 63*b* to the protruding portion 63*c*, the movement of the protruding portion 63*c* can be amplified and used as a movement of the hook portion 63*a*.

In addition, the temporary-joint release button 66 to be pressed down for releasing the temporary jointing state is covered by the operation lever 53. As a result, the temporary-joint release can be done, only after the operation lever 53 is rotated backward and the electrical connection and mechanical fixture are released. In other words, the action of releasing the temporary jointing can be done only after the electrical connection and the mechanical fixture are released.

In addition, the release of the electrical connection and mechanical fixture and the release of the temporary jointing are done respectively by separate members (the operation lever 53, the temporary-joint release button 66), and by a separate action. As a result, the release of the electrical connection and mechanical fixture and the release of the temporary jointing are not done inadvertently at one time.

In the present embodiment, if the center of gravity (not shown) of the lug member 63 is placed outer than the axis member 62, then a force that causes the lug member 63 to fall outer than its self-weight acts on the lug member 63. In other words, the self-weight becomes a biasing force that causes the lug member 63 to be directed toward the protruding position (T1). In this case, the first compression spring 64 can be omitted.

In the present embodiment, the compression spring 22 can serve both as a biasing means for biasing the slide member 23 backward, and as a biasing means for biasing the lug member 24 in the protruding direction. As a result, a biasing means for directly biasing the lug member 24 can be omitted, and the configuration can be simplified accordingly.

Embodiment 3

The power supply box device 3 to which the present invention according to Embodiment 3 is applied is described below, with reference to FIG. 17 and FIG. 18.

Figure 17:
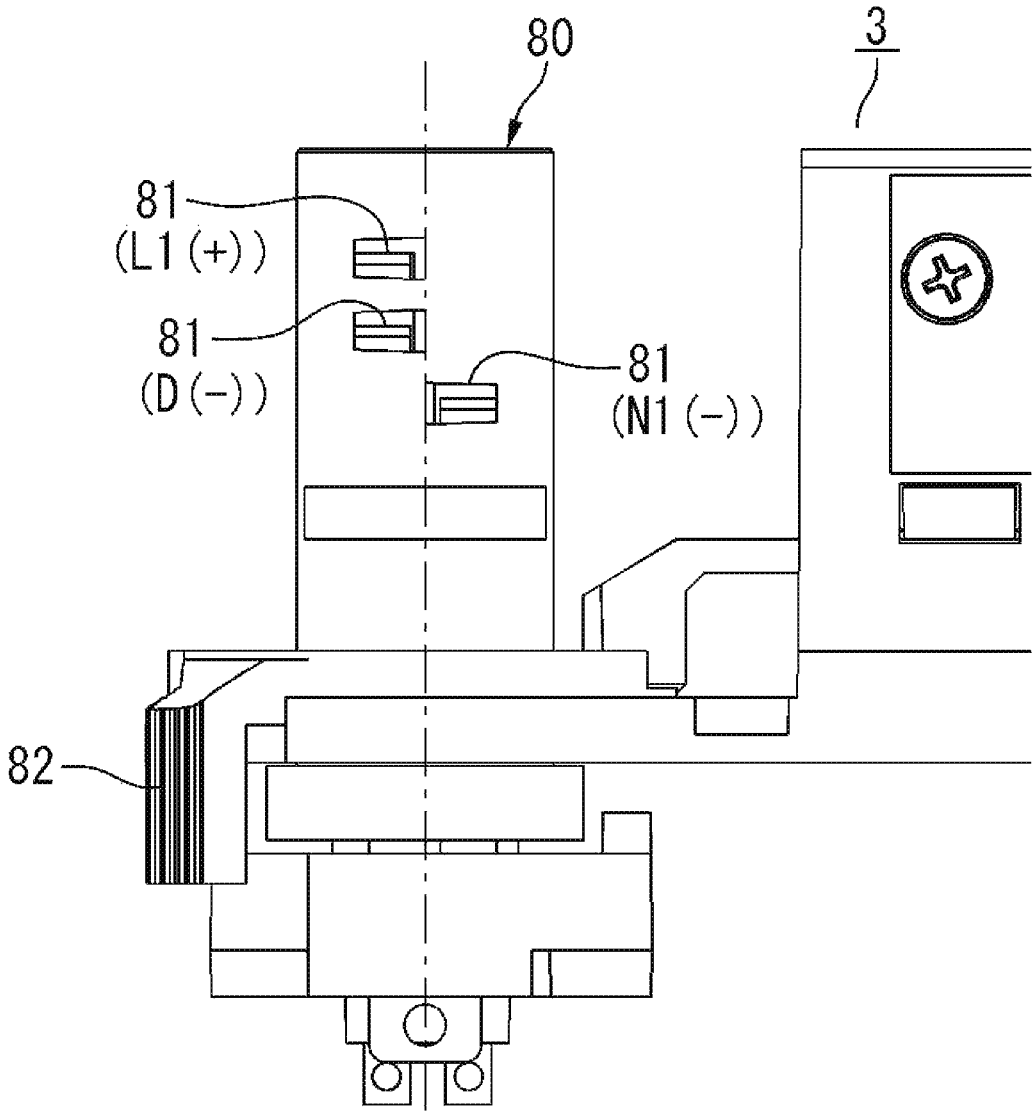
FIGS. 17 and 18 are diagrams illustrating a power supply box device 3 of Embodiment 3.

FIG. 17 is a left side view of the plug 80 of the power supply box device 3.

Figure 18:
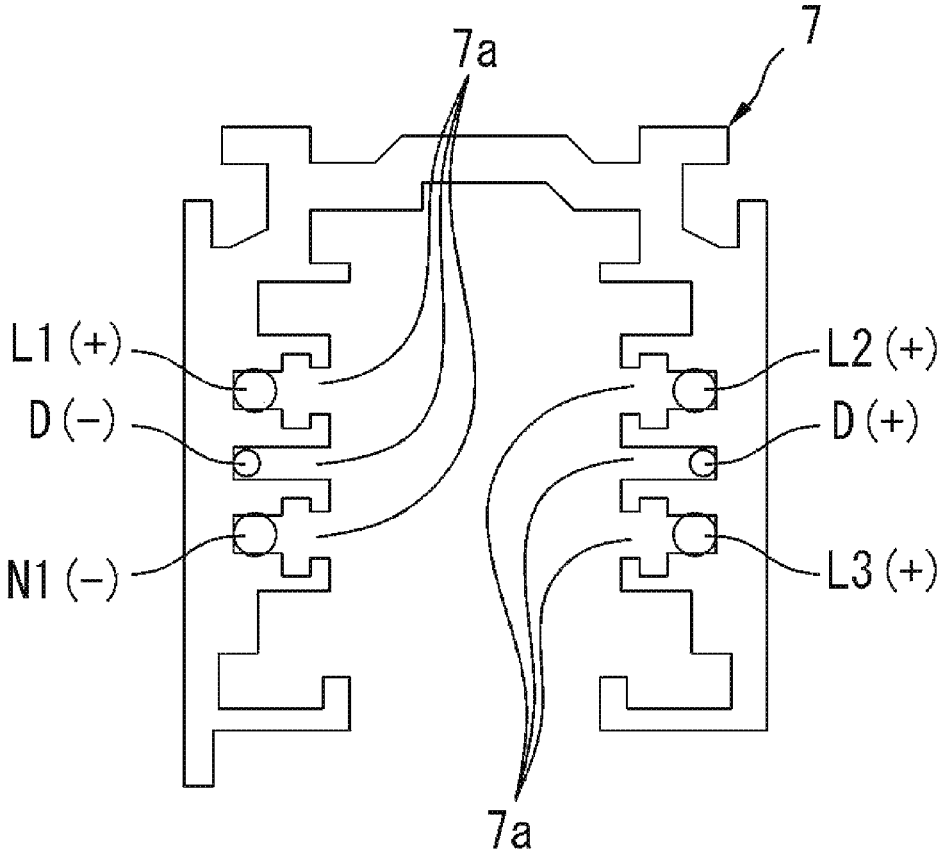

FIG. 18 is a front view of the wiring duct 7, with which or from which the plug 80 is engaged or disengaged.

In Embodiment 1 described above, an example is described in which respective bent portions 34*a* of the two electrodes 34 of the plug 30 extend outward respectively on the left and right on one stage, as illustrated in FIG. 6. In Embodiment 3, an example is described in which a total of six bent portions (wing portions) 81 extend outward on the left and right from the plug 80 for each stage, on three (upper, middle, and lower) stages as illustrated in FIG. 17, FIG. 18. As described above, the case in which the bent portions 81 are provided on multiple stages is also included in the present invention.

In the present embodiment, the total of six bent portions 81 are located at the three, upper, middle, and lower stages, and each of the bent portions 81 extends from the plug 80 on the left and right sides on each stage, so as to be connected to and disconnected from each conductive plate (conductive line) located in a wiring groove 7*a* in the wiring duct 7.

In other words, the bent portion 81 on the left upper stage is provided to be connected to and disconnected from a conductive plate (electrode) L1 (+), and the bent portion 81 on the left middle stage is provided to be connected to and disconnected from a conductive plate (data bus) D (−), and the bent portion 81 on the left lower stage is provided to be connected to and disconnected from a conductive plate (neutral) N1 (−).

In addition, the bent portion 81 on the right upper stage is provided to be connected to and disconnected from a conductive plate (electrode) L2 (+), and the bent portion 81 on the right middle stage is provided to be connected to and disconnected from a conductive plate (data bus) D (+), and the bent portion 81 on the right lower stage is provided to be connected to and disconnected from a conductive plate (electrode) L3 (+).

At this time, for example, a dial (not shown) for changing relative connection relationship in the plug 80 may be provided in the power supply box device 3. In this case, before the plug 80 is made in the state as illustrated in FIG. 17, an arbitrary one bent portion 81 that corresponds to one of the conductive plates (electrodes) L1 (+), L2 (+), L3 (+) is selected by the dial among the bent portions 81. By this operation, the bent portion 81 selected by the dial and the conductive plate (neutral) N1 (−) contact each other, and are conducted. In addition, when this contact occurs, the conductive plate (data bus) D (+) and D (−) contact each other, and are conducted.

On the other hand, if the plug 80 is rotated approximately 90 degrees through an operation lever 82 to cause each conductive plate to be directed in the front-back direction, then these contacts are broken, and the conduction between them can be disconnected.

Instead of selecting the bent portion 81 that corresponds to one of the conductive plates (electrodes) L1 (+), L2 (+), L3 (+) by the dial, by bringing the conductive plates (electrodes) L1 (+), L2 (+), L3 (+) into contact with a base end of corresponding three bent portions 81, a contact with the conductive plate (neutral) N1 (−) can be obtained by conducting any of the conductive plates (electrodes) L1 (+), L2 (+), L3 (+).

In the description above, examples in which the number of the bent portions 81 are six. However, in terms of the applicability of the present invention, the number of the bent portions 81 may be four. In this case, for example, four bent portions 81 are configured to be connected to and disconnected from the conductive plates (electrodes) L1 (+), L2 (+), and the conductive plates (neutral) N1 (−), N2 (−).

To put it in extreme terms, regardless of the number of the bent portions 81, the present invention can be applied to a power supply box device which becomes conductive when the bent portion 81 is directed in the left-right direction, and becomes nonconductive when the plug 80 is rotated approximately 90 degrees through the operation lever 82 and the bent portion 81 is directed in the front-back direction.

EXPLANATION OF REFERENCE NUMERALS

1, 2, 3: power supply box device
5: wiring duct
5*a*: duct groove
5*c*: rail portion
6: lighting fixture
10, 50: power supply box
11, 51: box body
11*a*, 51*a*: opening
12: housing
13: lever cover
14: lid member
20: temporary jointing mechanism
22, 64: compression spring (spring member, biasing means)
23, 61: slide member
23*d*: cam groove (cam surface)
24, 63: lug member
24*a*, 63*d*: inclined surface
24*b*, 63*c*: protruding portion (cam follower)
24*c*: sliding surface
25: guide member
30, 70: plug
31*m*, 53: operation lever
61*g*: cam surface
A, D: cam structure
B: retracting mechanism
C: mounting and removing apparatus
P1: locked position
P2: unlocked position
R1: first position (predefined position)
R2: second position
R3: third position
T1: protruding position
T2: retracting position

The invention claimed is:

1. A power supply box device to be mounted to a wiring duct from below comprising:

a power supply box including a box body having an opening that opens upward, and a lid member for closing the opening; and a plug having an operation lever protruding in a radial direction from a plug body and extending downward, and being supported by the lid member so as to be capable of being rotated forward and backward, wherein the box body includes: a housing for housing a power supply; and a lever cover supported by the housing so as to be capable of ascending and descending between an upper locked position and a lower unlocked position, and wherein the lever cover allows the rotation of the operation lever when disposed in the unlocked position, and, for the operation lever disposed in a predefined position, covers the operation lever by ascending from the unlocked position to the locked position.

2. The power supply box device according to claim 1 wherein:

the plug releases an electrical connection and a mechanical fixture between the wiring duct and the power supply box device by the backward rotation of the operation lever from a first position to a second position, and makes the electrical connection and the mechanical fixture between the wiring duct and the power supply box by the forward rotation from the second position to the first position, and the predefined position is the first position.

3. The power supply box device according to claim 2 wherein:

the lever cover is capable of ascending from the unlocked position to the locked position, only when the operation lever is disposed in the vicinity of the first position and when the electrical connection and the mechanical fixture between the wiring duct and the power supply box are made.

* * * * *